US010175620B2

(12) United States Patent
Yamada et al.

(10) Patent No.: US 10,175,620 B2
(45) Date of Patent: Jan. 8, 2019

(54) FIXING DEVICE AND IMAGE FORMING APPARATUS

(71) Applicant: Konica Minolta, Inc., Chiyoda-ku, Tokyo (JP)

(72) Inventors: Chiaki Yamada, Ibaraki (JP); Junya Hirayama, Takarazuka (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/655,185

(22) Filed: Jul. 20, 2017

(65) Prior Publication Data

US 2018/0024479 A1 Jan. 25, 2018

(30) Foreign Application Priority Data

Jul. 21, 2016 (JP) ..... 2016-143596

(51) Int. Cl.
*G03G 15/20* (2006.01)

(52) U.S. Cl.
CPC ..... *G03G 15/2042* (2013.01); *G03G 15/2046* (2013.01); *G03G 15/2053* (2013.01); *G03G 15/2064* (2013.01); *G03G 2215/2019* (2013.01); *G03G 2215/2038* (2013.01); *G03G 2215/2041* (2013.01); *G03G 2215/2045* (2013.01)

(58) Field of Classification Search
CPC ..... G03G 15/2046; G03G 2215/2019; G03G 2215/2038
See application file for complete search history.

(56) References Cited

U.S. PATENT DOCUMENTS

2010/0226700 A1* 9/2010 Yamada ..... G03G 15/2089 399/329
2011/0188907 A1* 8/2011 Seki ..... G03G 15/20 399/329
2012/0141174 A1* 6/2012 Kurita ..... G03G 15/161 399/329
2014/0086608 A1* 3/2014 Murakami ..... G03G 15/2085 399/67

FOREIGN PATENT DOCUMENTS

JP 2004-264398 A 9/2004
JP 2009-104019 A 5/2009
JP 2009-168909 A 7/2009

* cited by examiner

*Primary Examiner* — Victor Verbitsky
(74) *Attorney, Agent, or Firm* — Buchanan Ingersoll & Rooney PC

(57) ABSTRACT

In this fixing device, a pressing roller includes a pressing roller driving unit, and a heating roller includes a heating roller driving unit. Control is performed such that torque of the heating roller in torque distribution between the pressing roller and the heating roller is greater when a belt load reducing device is activated than when the belt load reducing device is not activated. A fixing device and an image forming apparatus thus can be provided, in which the fixability according to the kind of recording medium is excellent, the durability of the fixing belt is high, and the separability between the fixing belt and the recording medium is excellent.

14 Claims, 22 Drawing Sheets

FIG.16

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| EXAMPLE 1 | LEATHAC 66 | EMBODIMENT 1 | MODE I | 20 | 80 | A | A | A | A |
| EXAMPLE 2 | LEATHAC 66 | EMBODIMENT 1 | MODE I | 50 | 50 | A | A | A | A |
| EXAMPLE 3 | LEATHAC 66 | EMBODIMENT 1 | MODE I | 100 | 0 | A | A | A | A |
| EXAMPLE 4 | LEATHAC 66 | EMBODIMENT 1 | MODE I | 15 | 85 | B | A | A | B |
| EXAMPLE 5 | LEATHAC 66 | EMBODIMENT 1 | MODE II | 20 | 80 | A | A | B | B |
| EXAMPLE 6 | POD | EMBODIMENT 1 | MODE II | 0 | 100 | A | A | A | A |
| EXAMPLE 7 | POD | EMBODIMENT 1 | MODE II | 15 | 85 | A | A | B | B |
| EXAMPLE 8 | POD | EMBODIMENT 1 | MODE II | 20 | 80 | A | A | B | B |
| EXAMPLE 9 | POD | EMBODIMENT 1 | MODE I | 0 | 100 | A | B | A | B |
| EXAMPLE 10 | POD | EMBODIMENT 1 | MODE I | 20 | 80 | A | B | A | B |

FIG.17

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| EXAMPLE 11 | LEATHAC 75 | EMBODIMENT 2 | MODE I | 20 | 80 | A | A | A | A |
| EXAMPLE 12 | LEATHAC 75 | EMBODIMENT 2 | MODE I | 50 | 50 | A | A | A | A |
| EXAMPLE 13 | LEATHAC 75 | EMBODIMENT 2 | MODE I | 100 | 0 | A | A | A | A |
| EXAMPLE 14 | LEATHAC 75 | EMBODIMENT 2 | MODE I | 15 | 85 | B | A | A | B |
| EXAMPLE 15 | LEATHAC 75 | EMBODIMENT 2 | MODE II | 20 | 80 | A | A | B | B |
| EXAMPLE 16 | POD | EMBODIMENT 2 | MODE II | 0 | 100 | A | A | A | A |
| EXAMPLE 17 | POD | EMBODIMENT 2 | MODE II | 15 | 85 | A | A | B | B |
| EXAMPLE 18 | POD | EMBODIMENT 2 | MODE II | 20 | 80 | A | A | B | B |
| EXAMPLE 19 | POD | EMBODIMENT 2 | MODE I | 0 | 100 | A | B | A | B |
| EXAMPLE 20 | POD | EMBODIMENT 2 | MODE I | 20 | 80 | A | B | A | B |

FIG.18

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| EXAMPLE 21 | LEATHAC 66 | EMBODIMENT 3 | MODE I | 20 | 80 | A | A | A | A |
| EXAMPLE 22 | LEATHAC 66 | EMBODIMENT 3 | MODE I | 55 | 45 | A | A | A | A |
| EXAMPLE 23 | LEATHAC 66 | EMBODIMENT 3 | MODE I | 100 | 0 | A | A | A | A |
| EXAMPLE 24 | LEATHAC 66 | EMBODIMENT 3 | MODE I | 15 | 85 | B | A | A | B |
| EXAMPLE 25 | LEATHAC 66 | EMBODIMENT 3 | MODE II | 20 | 80 | A | A | B | B |
| EXAMPLE 26 | POD | EMBODIMENT 3 | MODE II | 0 | 100 | A | A | A | A |
| EXAMPLE 27 | POD | EMBODIMENT 3 | MODE II | 15 | 85 | A | A | B | B |
| EXAMPLE 28 | POD | EMBODIMENT 3 | MODE II | 20 | 80 | A | A | B | B |
| EXAMPLE 29 | POD | EMBODIMENT 3 | MODE I | 0 | 100 | A | B | A | B |
| EXAMPLE 30 | POD | EMBODIMENT 3 | MODE I | 20 | 80 | A | B | A | B |

FIG.19

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| EXAMPLE 31 | LEATHAC 66 | EMBODIMENT 4 | MODE I | 20 | 80 | A | A | A | A |
| EXAMPLE 32 | LEATHAC 66 | EMBODIMENT 4 | MODE I | 55 | 45 | A | A | A | A |
| EXAMPLE 33 | LEATHAC 66 | EMBODIMENT 4 | MODE I | 100 | 0 | A | A | A | A |
| EXAMPLE 34 | LEATHAC 66 | EMBODIMENT 4 | MODE I | 15 | 85 | B | A | A | B |
| EXAMPLE 35 | LEATHAC 66 | EMBODIMENT 4 | MODE II | 20 | 80 | A | A | B | B |
| EXAMPLE 36 | POD | EMBODIMENT 4 | MODE II | 0 | 100 | A | A | A | A |
| EXAMPLE 37 | POD | EMBODIMENT 4 | MODE II | 15 | 85 | A | A | B | B |
| EXAMPLE 38 | POD | EMBODIMENT 4 | MODE II | 20 | 80 | A | A | B | B |
| EXAMPLE 39 | POD | EMBODIMENT 4 | MODE I | 0 | 100 | A | B | A | B |
| EXAMPLE 40 | POD | EMBODIMENT 4 | MODE I | 20 | 80 | A | B | A | B |

FIG.20

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| EXAMPLE 41 | LEATHAC 75 | EMBODIMENT 5 | MODE I | 20 | 80 | A | A | A | A |
| EXAMPLE 42 | LEATHAC 75 | EMBODIMENT 5 | MODE I | 55 | 45 | A | A | A | A |
| EXAMPLE 43 | LEATHAC 75 | EMBODIMENT 5 | MODE I | 100 | 0 | A | A | A | A |
| EXAMPLE 44 | LEATHAC 75 | EMBODIMENT 5 | MODE I | 15 | 85 | B | A | A | B |
| EXAMPLE 45 | LEATHAC 75 | EMBODIMENT 5 | MODE II | 20 | 80 | A | A | B | B |
| EXAMPLE 46 | POD | EMBODIMENT 5 | MODE II | 0 | 100 | A | A | A | A |
| EXAMPLE 47 | POD | EMBODIMENT 5 | MODE II | 15 | 85 | A | A | B | B |
| EXAMPLE 48 | POD | EMBODIMENT 5 | MODE II | 20 | 80 | A | A | B | B |
| EXAMPLE 49 | POD | EMBODIMENT 5 | MODE I | 0 | 100 | A | B | A | B |
| EXAMPLE 50 | POD | EMBODIMENT 5 | MODE I | 20 | 80 | A | B | A | B |

FIG.21

| | EXPERIMENTAL CONDITIONS | | | | | EVALUATION RESULT | | | |
|---|---|---|---|---|---|---|---|---|---|
| | RECORDING MEDIUM KIND | FIXING DEVICE AND DEVICE CONFIGURATION | | TORQUE DISTRIBUTION | | FIXABILITY | SEPARABILITY | BELT DURABILITY | TOTAL EVALUATION |
| | | | | Th | Tp | | | | |
| COMPARATIVE EXAMPLE 1 | LEATHAC 66 | EMBODIMENT 1 | MODE I | 0 | 100 | C | A | A | C |
| COMPARATIVE EXAMPLE 2 | LEATHAC 75 | EMBODIMENT 2 | MODE I | 0 | 100 | C | A | A | C |
| COMPARATIVE EXAMPLE 3 | LEATHAC 66 | EMBODIMENT 3 | MODE I | 0 | 100 | C | A | A | C |
| COMPARATIVE EXAMPLE 4 | LEATHAC 66 | EMBODIMENT 4 | MODE I | 0 | 100 | C | A | A | C |
| COMPARATIVE EXAMPLE 5 | LEATHAC 75 | EMBODIMENT 5 | MODE I | 0 | 100 | C | A | A | C |

FIG.22

| EVALUATION ITEM | GRADE | |
|---|---|---|
| FIXABILITY | A | IMAGE DENSITY RETENTION RATIO IS 90% OR HIGHER. |
| | B | IMAGE DENSITY RETENTION RATIO IS 80% OR HIGHER AND LESS THAN 90%. |
| | C | IMAGE DENSITY RETENTION RATIO IS LESS THAN 80%. |
| SEPARABILITY | A | IMAGE SURFACE IS NOT WOUND AROUND FIXING BELT AND NO JAM OCCURS DURING SEPARATION. |
| | B | IMAGE SURFACE IS MOMENTARILY WOUND AROUND FIXING BELT BUT NO JAM IS CAUSED DURING SEPARATION. |
| | C | IMAGE SURFACE IS WOUND AROUND FIXING BELT AND JAM OCCURS DURING SEPARATION. |
| BELT DURABILITY | A | BASE MATERIAL OF FIXING BELT HAS NO DAMAGE AND IS SATISFACTORY. |
| | B | SLIGHT CRACK DAMAGE IS OBSERVED IN BASE MATERIAL OF FIXING BELT. |
| | C | CRACK DAMAGE IS OBSERVED IN BASE MATERIAL OF FIXING BELT |

FIXING DEVICE AND IMAGE FORMING APPARATUS

Japanese Patent Application No. 2016-143596 filed on Jul. 21, 2016, including description, claims, drawings, and abstract the entire disclosure is incorporated herein by reference in its entirety.

BACKGROUND

Technological Field

The present invention relates to a fixing device and an image forming apparatus including the same.

Description of the Related Art

In recent years, an image forming apparatus is required to be capable of instantaneously heating the heating member in the fixing device in the image forming apparatus to a predetermined temperature to minimize the waiting time (warmup time), in view of energy saving or in view of not keeping users waiting during use of the image forming apparatus. Based on this, belt-type fixing devices including a fixing belt with a small heat capacity have been used.

A fixing device having a fixing pad arranged to be opposed to a pressing member for pressing a fixing belt from the inside has been widely used, because efficient fixing can be performed by setting the length and the pressure of the fixing nip section as desired.

Meanwhile, there is a growing demand for a wide variety of recording media, and the fixing device of the image forming apparatus is required to be adapted to various kinds of recording media including paper with different thicknesses, paper with large projections and depressions such as embossed paper, and envelopes.

Configuration of Upper Belt Pad-Type Fixing Device

An upper belt pad-type fixing device includes an elastic and flexible pressing roller driven to rotate, an endless fixing belt in abutment with the pressing roller and looping while forming a fixing nip section through which a recording medium is inserted, a fixing pad having a flat portion for pressing the fixing belt from the inside with the flat portion to form the fixing nip section into an approximately flat shape, and a heating roller disposed in the loop of the fixing belt and having a heat source such as a halogen lamp in the inside. The fixing belt is heated through heat conduction from the heat source.

Advantages and Problems of Upper Belt Pad Type

The upper belt pad-type fixing device can achieve a shorter activation time and smaller preheating electricity because of the fixing belt with a small heat capacity. In addition, the length and the pressure of the fixing nip section can be set as desired by changing the shape of the fixing pad pressing the fixing belt from the inside, and efficient fixing can be achieved.

In the upper belt pad fixing device, in general, the fixing belt is driven and conveyed by driving torque of the pressing roller. In this case, friction force is produced between the fixing belt and the fixing pad, and the fixing belt is distorted by the action of the pulling force of the pressing roller. In this case, when a recording medium is passed through, shear force occurs between the recording medium and the fixing belt. When the recording medium is rough paper (paper with projections and depressions), the toner image in the vicinity of the boundary between the projection and the depression of the recording medium is twisted (wrinkled) by the shear force to cause fixing failure. In this way, when the pressing roller driving is employed, there is a problem of fixability on the recording medium having projections and depressions.

Upper Driving System

It has been found that driving the fixing belt is effective as an approach for suppressing the shear force at the fixing nip. A method of driving the fixing belt is shown in Japanese Laid-Open Patent Publication No. 2004-264398. Japanese Laid-Open Patent Publication No. 2004-264398 employs a configuration including a driving roller for pulling up the fixing belt at the exit of the fixing nip.

When the belt driving is employed, however, the radius of curvature of the belt at the fixing nip exit is reduced because the belt is pulled up in conformity with the pad shape. In this case, the load on the fixing belt increases to deteriorate the durability of the fixing belt.

It has then been found that changing the belt shape (curvature) at the fixing nip exit is effective as an approach for reducing the load on the fixing belt. A method of changing the belt shape at the fixing nip exit is disclosed in Japanese Laid-Open Patent Publication No. 2009-104019. In Japanese Laid-Open Patent Publication No. 2009-104019, in order to reduce the stress on the fixing belt, a cam is pressed against the inside of the loop of the fixing belt to change the shape of the belt.

Another factor of the load exerted on the fixing belt is a pressure increase at the fixing nip exit. Japanese Laid-Open Patent Publication No. 2009-168909 illustrates a method of adjusting the pressure at the fixing nip exit by changing the angle of the fixing pad.

SUMMARY

Unfortunately, the configurations disclosed in Japanese Laid-Open Patent Publication No. 2009-104019 and Japanese Laid-Open Patent Publication No. 2009-168909 pose another problem illustrated below. In either of Japanese Laid-Open Patent Publication No. 2009-104019 and Japanese Laid-Open Patent Publication No. 2009-168909, belt driving is not employed, and the fixing belt is conveyed by driving of the pressing roller. For this reason, shear force is exerted at the fixing nip, and there is a problem in fixability on a recording medium having projections and depressions on its surface.

In the case of the pressing roller driving, the force applied for conveying the fixing belt disappears at the fixing nip exit to loosen the fixing belt and increase the radius of curvature, which leads to poor separability between the fixing belt and the recording medium.

The present invention is made in view of the problems as described above and is aimed to provide a fixing device which has favorable fixability in accordance with the kinds of recording media, has a highly durable fixing belt, and is excellent in separability between the fixing belt and the recording medium.

This fixing device fixes a toner image on a recording medium. The fixing device includes an endless fixing belt, a heating roller disposed in a loop of the fixing belt to drive the belt, a pressing roller disposed to be opposed to the fixing belt to form a fixing nip through which the recording medium passes, a pressing roller driving unit configured to drive the pressing roller, a heating roller driving unit configured to drive the heating roller, a fixing pad disposed in the loop of the fixing belt so as to be opposed to the pressing roller, a belt load reducing device configured to reduce load on the fixing belt on the exit side of the fixing nip, and a control unit configured to control the pressing roller driving unit, the heating roller driving unit, and the belt load reducing device.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 16 shows the evaluation results of Example 1 to Example 10.

FIG. 17 shows the evaluation results of Example 11 to Example 20.

FIG. 18 shows the evaluation results of Example 21 to Example 30.

FIG. 19 shows the evaluation results of Example 31 to Example 40.

FIG. 20 shows the evaluation results of Example 41 to Example 50.

FIG. 21 shows the evaluation results of Comparative Example 1 to Comparative Example 5.

FIG. 22 shows evaluation grades of fixability, separability, and belt durability of Examples and Comparative Examples.

DETAILED DESCRIPTION OF EMBODIMENTS

Figure 1:
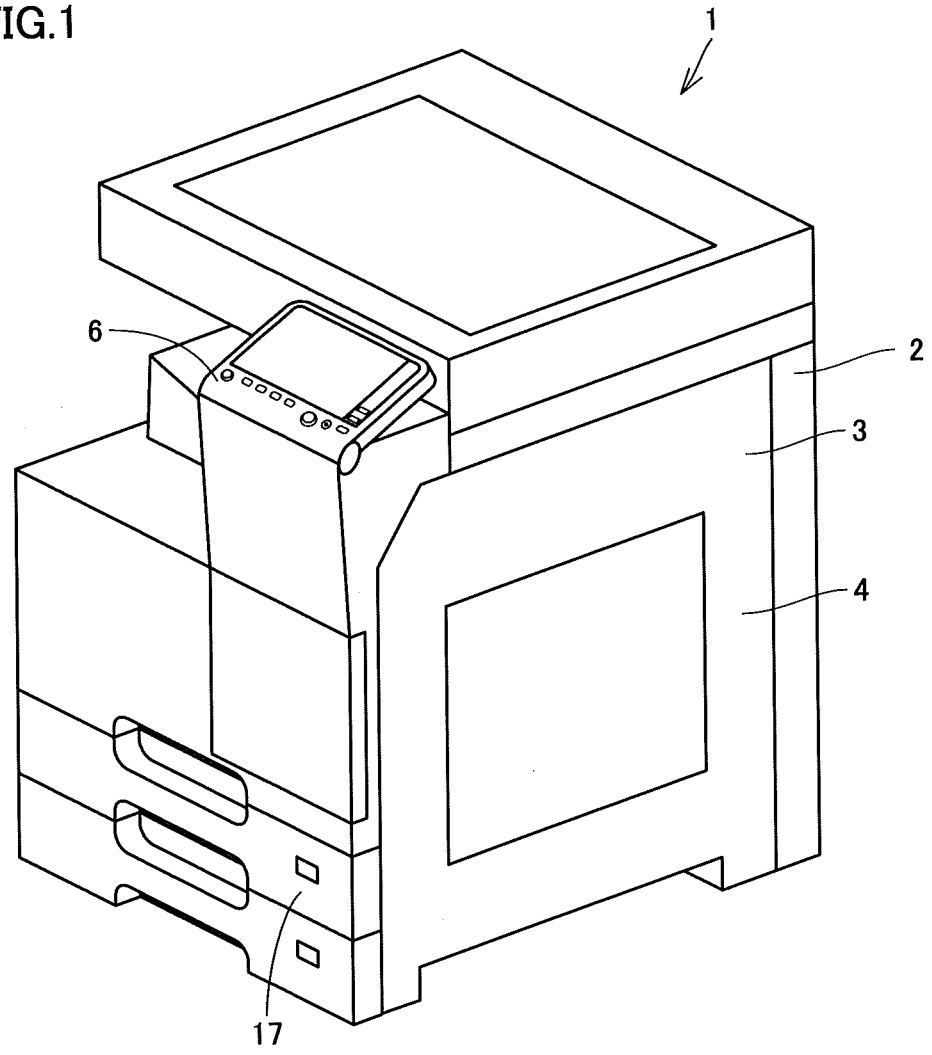
FIG. 1 is a perspective view showing the overall configuration of an image forming apparatus.

Hereinafter, one or more embodiments of the present invention will be described with reference to the drawings. However, the scope of the invention is not limited to the disclosed embodiments.

A fixing device for use in an image forming apparatus in embodiments based on the present invention will be described below with reference to the drawings. In the embodiments described below, when the number, quantity, etc. are mentioned, the scope of the present invention is not necessarily limited to the mentioned number, quantity, etc., unless otherwise specified. The same components and corresponding components are denoted with the same reference numerals, and an overlapping description may not be repeated. The drawings are not always to scale, and some parts are illustrated on a different scale to clarify the structure for easy understanding of the structure.

Related Art: Image Forming Apparatus 1

Referring to FIG. 1, an overall configuration of an image forming apparatus 1 will be described. FIG. 1 is a perspective view showing an overall configuration of image forming apparatus 1.

Referring to FIG. 1, image forming apparatus 1 is, for example, a copier, a printer, a facsimile, or a multifunction peripheral, and employs an electrophotographic system as the process for forming an image on paper. In the electrophotographic system, a developer image is formed as a visible image on a photoconductor and transferred to paper such as standard paper. In order to retain this developer image on paper as a pennanent image on a sheet, for example, the developer image is passed through a heating fixing device to fix the developer, and the paper medium is then discharged to the outside of image forming apparatus 1.

Image forming apparatus 1 includes a body casing 2. This body casing 2 includes an image forming unit 3 and a paper feeding unit 4 for storing a plurality of sheets of paper to be conveyed to image forming unit 3 in the lower section of image forming unit 3. In image forming unit 3, a development device, a fixing device, and the like are disposed. Paper feeding unit 4 includes a plurality of paper cassettes 17 loaded with paper of the same size or paper of different sizes. In the upper part of body casing 2, an operation panel 6 is provided for making various settings of image forming apparatus 1.

Figure 2:
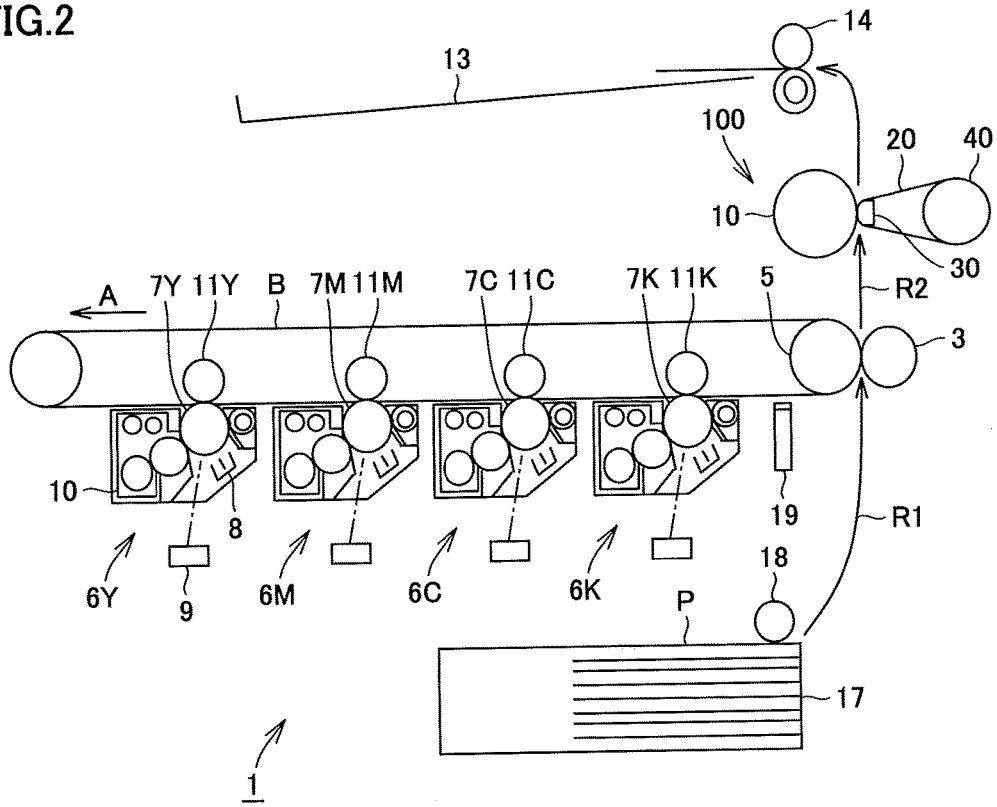
FIG. 2 is a diagram showing the internal configuration of the image forming apparatus.

Referring to FIG. 2, the internal configuration of image forming apparatus 1 will be described. FIG. 2 is a diagram showing the internal configuration of the image forming apparatus.

Under the lower horizontal portion of an intermediate transfer belt B, four imaging units 6Y, 6M, 6C, 6K corresponding to yellow (Y), magenta (M), cyan (C), black (K), respectively, are disposed in a row along intermediate transfer belt B.

Imaging units 6Y, 6M, 6C, 6K have photoconductor drums 7Y, 7M, 7C, 7K, respectively. On the periphery of each of photoconductor drums 7Y, 7M, 7C, 7K, a charger 8, a print head 9, a developing device, and a primary transfer roller 11Y, 11M, 11C, 11K opposed to photoconductor drum 7Y, 7M, 7C, 7K with intermediate transfer belt B interposed are disposed in order along the direction of rotation of each photoconductor drum.

A secondary transfer roller 3 is in pressure contact with the portion of intermediate transfer belt B that is supported on an intermediate transfer belt driving roller 5. The nip section between secondary transfer roller 3 and intermediate transfer belt B serves as a secondary transfer region. At a downstream position in a conveyance path R2 following the secondary transfer region, a fixing device 100 including a pressing roller 10 and a heating roller 40 is disposed.

In the lower part of image forming apparatus 1, a paper cassette 17 is removably disposed. Paper P stacked in the inside of paper cassette 17 is sent one by one from the top to conveyance path R1 through rotation of a paper feeding roller 18. Between imaging unit 6K located most downstream of intermediate transfer belt B and the secondary transfer region, an auto image density control (AIDC) sensor 19 also serving as a registration sensor is installed.

In image forming apparatus 1 configured as described above, the user can operate operation panel 6 to view and select the kind of recording medium. The kind of recording medium may be detected using a sensor (not shown) provided in image forming apparatus 1.

Image forming apparatus 100 is not limited to the configuration described above. Although not shown, a full-color image forming apparatus may be used, in which a rotating developing device holding a plurality of developing devices is rotated so that the developing devices are successively guided to a photoconductor drum to form a full-color image. Furthermore, an image forming apparatus forming a monochrome image may be used.

Related Art: Configuration of Fixing Device 100

Figure 3:
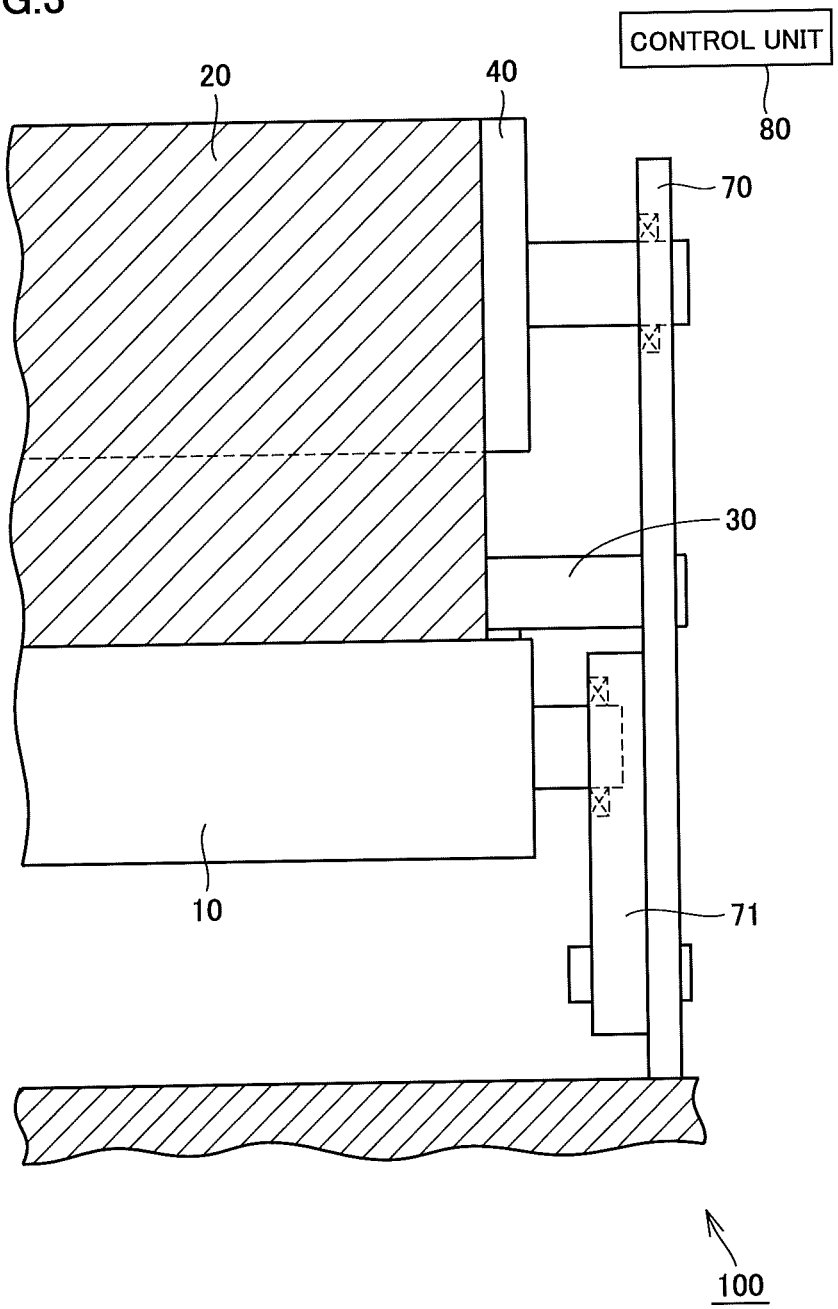
FIG. 3 is a partial enlarged view showing the configuration of a fixing device.
Figure 4:
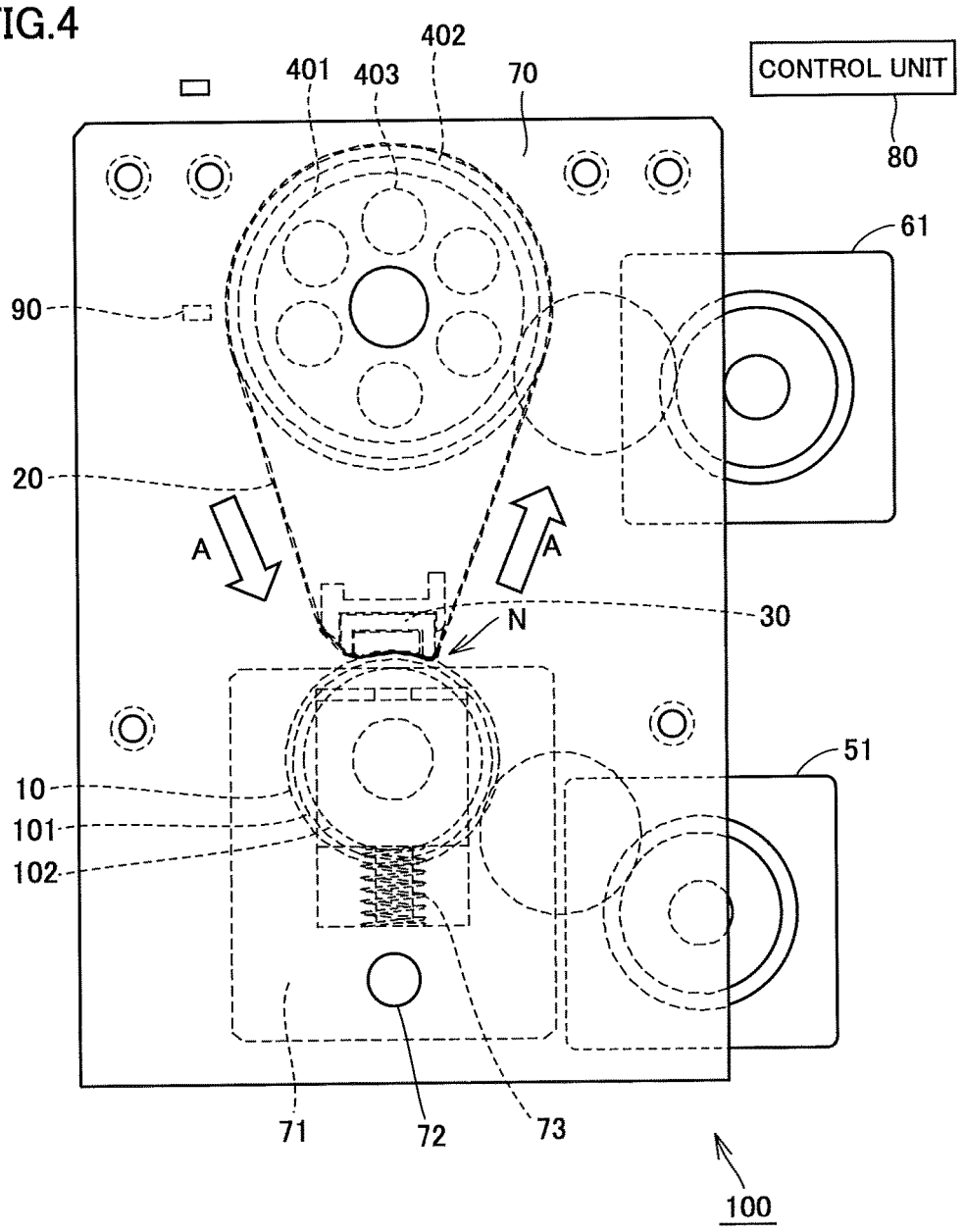
FIG. 4 is a side view showing the configuration of the fixing device.

Referring to FIG. 3 and FIG. 4, the configuration of fixing device 100 used in the aforementioned image forming apparatus 1 will be described. FIG. 3 is a partial enlarged view showing the configuration of fixing device 100, and FIG. 4 is a side view showing the configuration of fixing device 100. An endless fixing belt 20 is suspended between a fixing pad 30 and heating roller 40. At the position opposed to fixing pad 30, pressing roller 10 is provided to form a fixing nip N with fixing belt 20 interposed.

Heating roller 40 is rotatably supported by a side chassis 70. Though not shown, a biasing member for applying upward force to heating roller 40 is provided to give adequate tension to fixing belt 20. Fixing pad 30 is also supported by side chassis 70 in the same manner.

Pressing roller 10 includes a pressing retraction mechanism 71 for applying an adequate pressure to fixing pad 30. This pressing retraction mechanism 71 is supported by side chassis 70 and a rotatable shaft 72 and is retractable from the position opposed to fixing pad 30 when pressing roller 10 is not in use. A biasing member 73 is also provided to apply pressure to fixing pad 30.

(Heating Roller 40)

Heating roller 40 has a laminated PTFE coat 402, for example, on the outer peripheral surface (front surface) of a cylindrical core 401. The outer diameter is about 60 mm. An aluminum plate having a thickness of about 1 mm is used for core 401. Heating roller 40 has a relatively small heat capacity.

In the inside of heating roller 40, a plurality of heater lamps 403 are provided to heat heating roller 40 through electrothermal conversion. When one or more heater lamps 403 heat heating roller 40, fixing belt 20 looped around and travelling on heating roller 40 is heated, and the heated fixing belt 20 heats a recording medium passing through fixing nip N.

Heater lamps 403 are configured with, for example, halogen heater lamps and disposed around the axis of heating roller 40 at regular intervals in the circumferential direction on the circumference of a circle with a certain radius about the axis of heating roller 40. The power rating of heater lamps 403 is, for example, 1500 W in total.

Heater lamp 403 is supplied with power to turn on (generate heat) and heat heating roller 40 with the amount of heat generation proportional to the supplied power. Heater lamps 403 have the same length of about 290 mm in the center axial direction. In order to ensure the fixability at both end portions of fixing belt 20 in the width direction (the direction orthogonal to the travelling direction), the light distribution (light intensity, equivalent to heating intensity) at both end portions in the longitudinal direction is greater than the light distribution at the central portion in the longitudinal direction.

In the present embodiment, the light distribution at portions having a length of 20 mm at both ends in each heater lamp 403 is 115% when the light distribution at the central portion having a length of 250 mm excluding both ends is 100%.

In the vicinity of heating roller 40, a temperature sensor 90 is provided to detect the surface temperature of fixing belt 20 looped around heating roller 40. Temperature sensor 90 is disposed to be opposed to the upstream portion in the traveling direction (arrow A in the figure) of fixing belt 20 looped around heating roller 40. A non-contact thermistor is used as temperature sensor 90 in the present embodiment.

(Fixing Pad 30)

Figure 5:
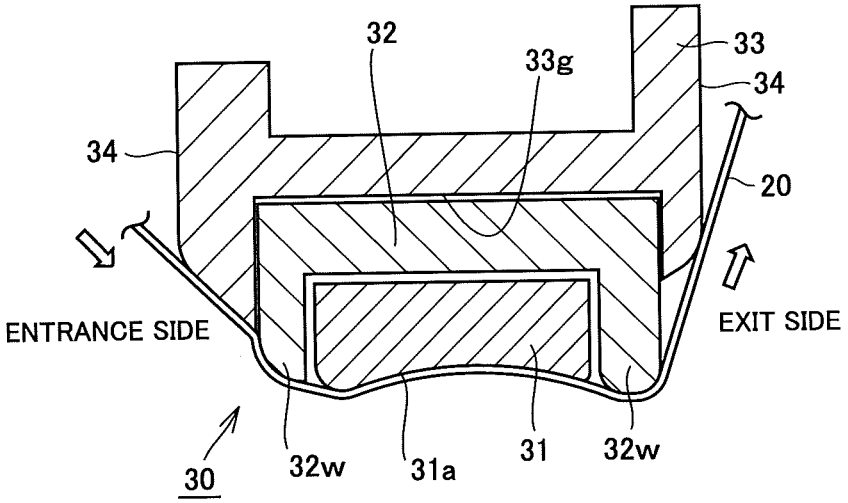
FIG. 5 is a cross-sectional view of a fixing pad with a fixing belt.

Referring to FIG. 5, the configuration of fixing pad 30 will be described. FIG. 5 is a cross-sectional view of fixing pad 30 with fixing belt 20. Fixing pad 30 includes a rigid pad holder 33 as a base structure and is formed from aluminum as a material. Iron, SUS, or heat-resistant resin may be used. The upstream of pad holder 33 may be formed to have a curved surface in conformity with fixing belt 20. The back surface of pad holder 33 has a depressed groove 33*g*. A first fixing pad 31 and a second fixing pad 32, which have low heat conductivity and are elastic, are fixed to this groove 33*g*.

Here, two kinds of materials are used for fixing pads. Second fixing pad 32 is harder than first fixing pad 31 and formed to surround first fixing pad 31 as shown in FIG. 5. Second fixing pad 32 is rectangular in cross section. A silicone rubber material is used for first fixing pad 31 and second fixing pad 32. For example, fluoro rubber may be used as the material other than silicone rubber. Second fixing pad 32 may be formed of PPS (polyphenylene sulfide) resin or PES (polyether sulfone) resin.

The surface of first fixing pad 31 is configured as a concave surface 31*a* in conformity to the surface shape of pressing roller 10. Of sidewalls 32*w* of second fixing pad 32 that hold first fixing pad 31 between both sides thereof, sidewall 32*w* located on the downstream side protrudes downward (toward pressing roller 10) relative to first fixing pad 31. As a result, at the exit of fixing nip N, the pressure is higher at the exit side than the entrance side of fixing nip N. This is to favorably affect the fixing strength and the separability of a recording medium.

Upstream of pad holder 33, a sliding member 34 is fixed. Sliding member 34 reduces the friction force between fixing pad 30 and fixing belt 20. Sliding member 34 is installed so as to cover from the upstream curved surface of pad holder 33, first fixing pad 31 and second fixing pad 32, further to the downstream portion of pad holder 33.

An example of the material of sliding member 34 is nonwoven fabric impregnated with fluorine-based resin for reducing the friction force. Another example may be a sheet formed of fabric of fluorocarbon resin. Fixing pad 30 as described above is fixed to side chassis 70. Although not shown, a stopper member for preventing displacement of fixing belt 20 is provided at an end portion of pad holder 33.

(Fixing Belt 20)

Figure 6:
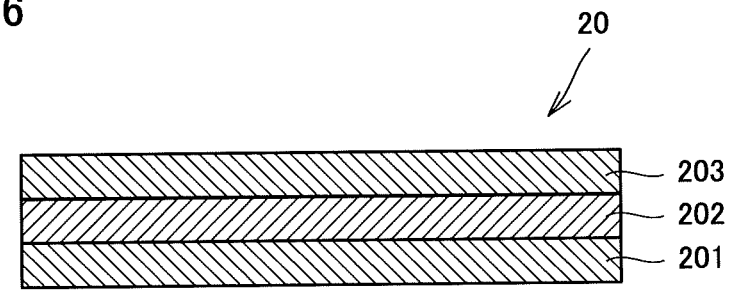
FIG. 6 is a sectional view of the fixing belt.

Referring to FIG. 6, the structure of fixing belt 20 will be described. FIG. 6 is a sectional view of fixing belt 20. Fixing belt 20 has a base material 201 formed of nickel having a thickness of 50 μm in a cylindrical shape with an outer diameter of 80 mm, an elastic layer 202 laminated on the front surface (outer peripheral surface) of base material 201, and a release layer 203 laminated on the front surface (outer peripheral surface) of elastic layer 202. Fixing belt 20 is looped around heating roller 40 and fixing pad 30 with a predetermined tension to have an elongated circle along the horizontal direction.

Silicone rubber having a thickness of 200 μm is used for elastic layer 202 of fixing belt 20. A tube of PFA (tetrafluoroetylene-perfluoroalkylvinylether copolymer) resin having a thickness of 30 μm is used for release layer 203. Fixing belt 20 having such a configuration has a relatively small heat capacity.

(Pressing Roller 10)

Referring to FIG. 4 again, pressing roller 10 has a core 101 of aluminum (thickness of 5 mm), an elastic layer 102 laminated on the outer peripheral surface (surface) of core 101, and a release layer (not shown) laminated on the outer peripheral surface (surface) of elastic layer 102. Silicone rubber is used for elastic layer 102. For example, a tube made of PFA resin having a thickness of 30 μm is used for the release layer.

Pressing roller 10 is configured to be highly high rigid because of having core 101 made of aluminum having a thickness of 5 mm. Moreover, its heat capacity is higher than that of fixing belt 20. The outer diameter of pressing roller 10 is shaped like a reversed crown such that the diameter is reduced toward the center in the longitudinal direction. When the outer shape of the end portion is D1 and the outer diameter of the central portion is D2, the difference between them is the amount of reversed crown. The amount of reversed crown is set to about 0.1 mm to 0.8 mm. Pressing roller 10 is rotated by a pressing roller driving unit 51 at a predetermined surface velocity.

(Fixing Member Driving Unit)

Fixing device 100 has a pressing roller driving unit 51 for rotating pressing roller 10 and a heating roller driving unit 61 for rotating heating roller 40. These driving units may be general AC motors but here DC brushless motors are used. The structure is similar to that of permanent magnet synchronous motors of AC motors. More specifically, permanent magnets are used for a rotor, and the rotation position of the rotor is sensed and referred to, for example, by a Hall element to generate a rotating magnetic field, which is controlled to control torque and speed. These driving units are each connected with a motor driver circuit (described later) to supply driving electric power to the driving unit.

(Motor Driver)

Figure 7:
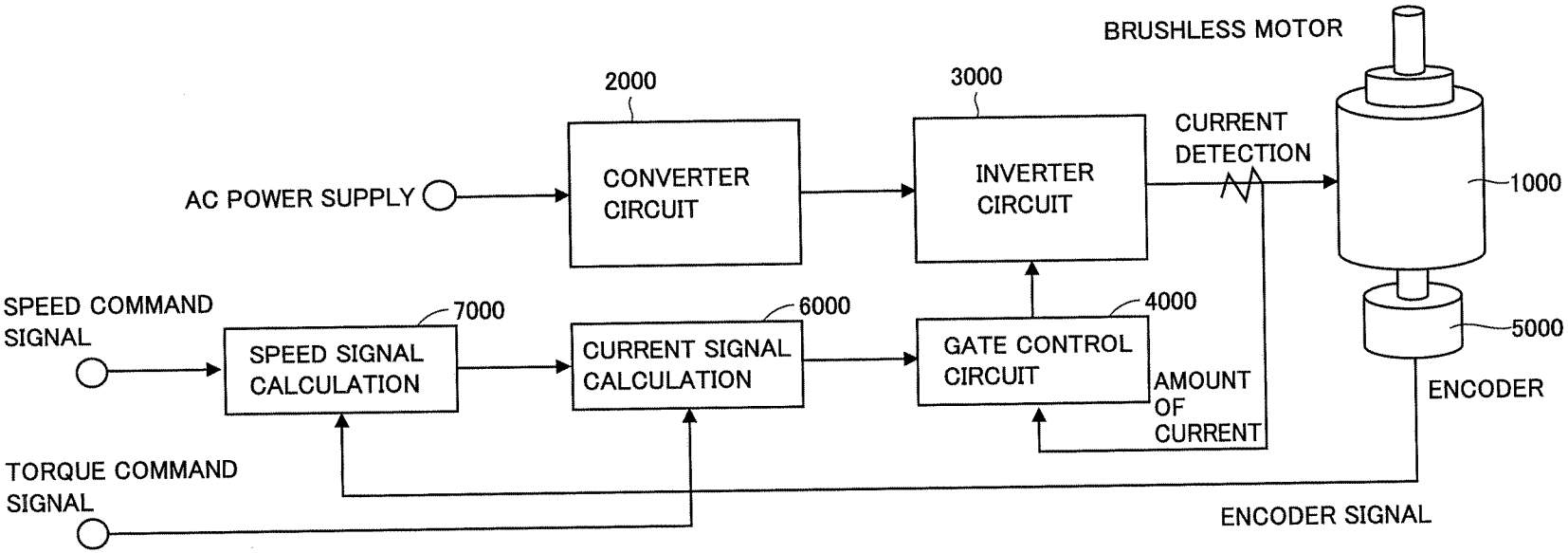
FIG. 7 is a schematic block diagram for explaining the functions of a typical driver of a motor.

Referring to FIG. 7, the driver for the motor will be described. FIG. 7 is a schematic block diagram for explaining the functions of a typical driver. A DC brushless motor 1000 to be used is generally supplied with three-phase electric power for generating a rotating magnetic field. Its frequency and electric power are controlled to control rotational speed and torque.

This three-phase electric power is generated by an inverter circuit 3000 after commercially available power supply (AC power supply) is converted to DC by a converter circuit 2000 in the figure. Its frequency or electric power can be adjusted as desired by controlling the gate of a power device for use in the inverter. A gate signal is generated by a gate control circuit 4000 in the figure. A feedback circuit is formed by referring to the supplied electric power and the rotational speed in generating the signal.

To control the speed, the number of revolutions of the driving unit (or target) is monitored by an encoder 5000 and is compared with an externally input speed command value. This is performed in a speed signal calculation unit 7000 in the figure. To control the torque, current (electric power) output by the inverter is monitored and compared with an externally input torque command value. This is performed in a current signal calculation unit 6000 in the figure. A gate signal is generated based on such calculation results to adjust frequency and electric power, thereby achieving the desired rotational speed and the desired torque.

Such drivers are commercially available from various manufacturers and can be used in combination with a variety of brushless motors. Most drivers include a speed control mode and a torque control mode, which can be switched, for example, by a switch.

(Motor Driving Method)

A control unit 80 of this fixing device 100 can control the torque distribution between pressing roller driving unit 51 and heating roller driving unit 61. The method will be described below. When pressing roller driving unit 51 is mainly used to drive fixing device 100, the pressing roller motor driver connected to pressing roller driving unit 51 is used in the speed control mode. This allows pressing roller 10, the recording medium, and fixing belt 20 to be conveyed stably at a constant speed. In doing so, the heating roller motor driver connected to heating roller driving unit 61 is set in the torque control mode.

When the torque command value to the heating roller motor driver is set to zero, basically the driving is done by pressing roller driving unit 51 alone. A certain torque command value is applied to allow heating roller driving unit 61 to assist in fixing driving. When the assist ratio of heating roller driving unit 61 is increased, heating roller driving unit 61 mainly drives fixing device 100. In this case, the heating roller motor driver is switched to the speed control mode. This is to prevent the conveyance speed of the recording medium from becoming unstable.

That is, when heating roller driving unit 61 is mainly used to drive the fixing device, the pressing roller motor driver is set to the torque control mode and the heating roller motor driver is set to the speed control mode. In switching, it is necessary to separately store the speed control command to each motor driver into, for example, a storage device of a control circuit (CPU) as speed data so that the speed of the recording medium does not change.

In this manner, it is possible to freely change the torque distribution between both driving units by controlling the torque of the driving unit under torque control. Specifically, the torque command value (analog signal) for the motor driver under torque control may be changed. Both motor drivers have torque output signals, which can be measured to monitor the torque of pressing roller driving unit 51 and heating roller driving unit 61. The torque signal is torque generated by the driving unit and need to be converted into driving torque of each member (pressing roller 10, heating roller 40). The torque shown in Examples described later is the value after conversion.

First Embodiment: Fixing Device 100A . . . Changing Belt Discharge Angle

Figure 8:
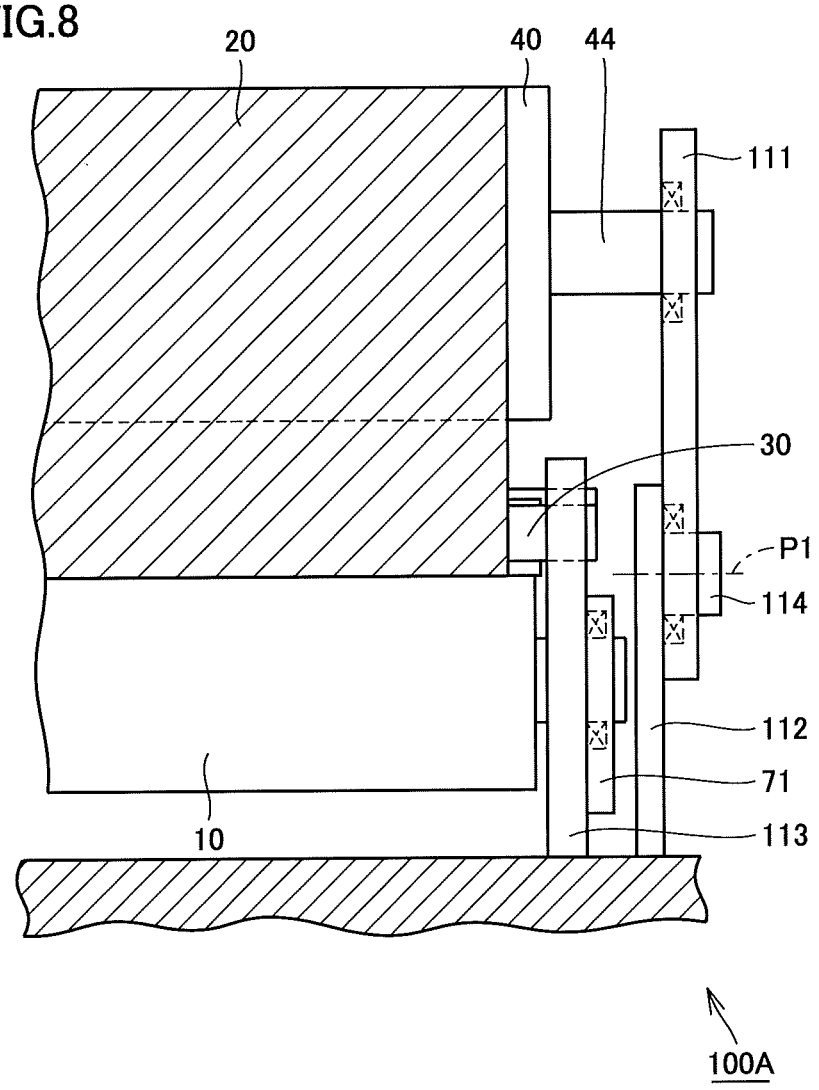
FIG. 8 is a partial enlarged view showing the configuration of the fixing device in a first embodiment.
Figure 9:
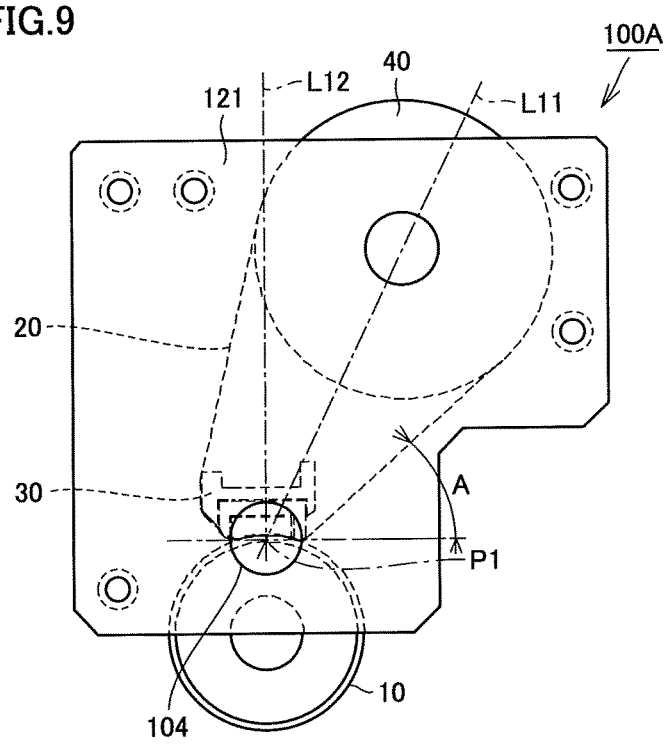
FIG. 9 is a side view showing the configuration of the fixing device in a "mode I" state in the first embodiment.
Figure 10:
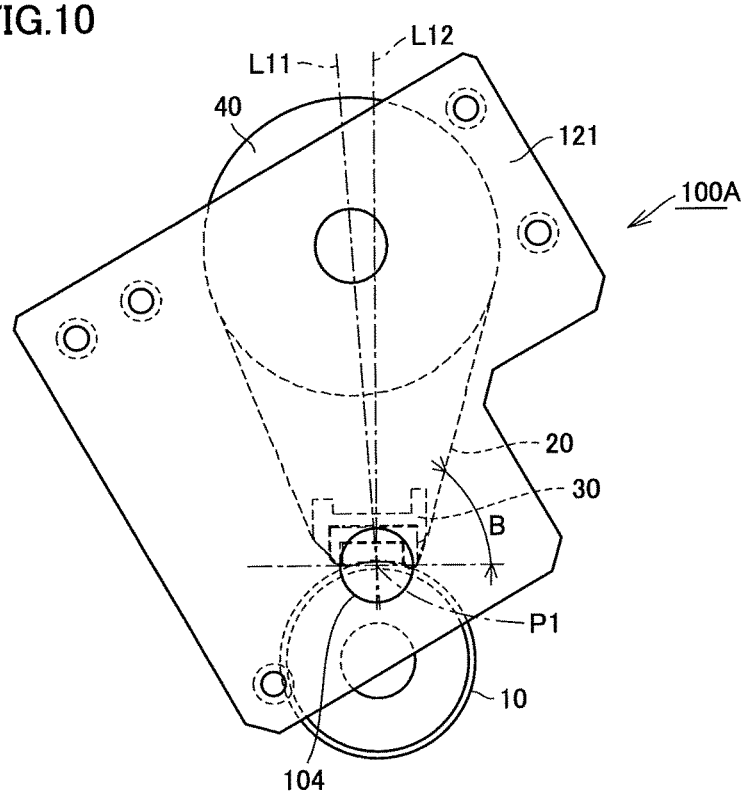
FIG. 10 is a side view showing the configuration of the fixing device in a "mode II" state in the first embodiment.

Referring to FIG. 8 to FIG. 10, the configuration of a fixing device 100A in a first embodiment will be described.

FIG. 8 is a partial enlarged view showing the configuration of fixing device 100A, FIG. 9 is a side view showing the configuration of the fixing device in a "mode I" state, and FIG. 10 is a side view showing the configuration of the fixing device in a "mode II" state.

The basics such as fixing pad 30, heating roller 40, and pressing roller 10 are as described above, except that pressing roller 10 and fixing pad 30 are supported by a side chassis 113. Pressing roller 10, which is not shown in detail in the figure, presses fixing pad 30 and has a retraction mechanism that is retracted from the position opposed to fixing pad 30 when not used. Heating roller 40 is supported by a side chassis 111.

Side chassis 111 is pivotably supported on a base chassis 112 using a rotational shaft 114, and side chassis 111 is rotatably supported on base chassis 112. This configuration can be employed to change the positional relation between heating roller 40 and fixing pad 30.

In FIG. 9, heating roller 40 is positioned on the downstream side of the recording medium passage of fixing pad 30, and angle A (about 42°) of fixing belt 20 downstream of the fixing nip exit of fixing pad 30 is small relative to the horizontal plane. Specifically, straight line L11 passing through shaft center P1 of rotational shaft 104 and the rotational axis center of heating roller 40 is inclined toward the exit side (downstream side) of fixing nip N in the figure, relative to vertical line L12 passing through shaft center P1 of rotational shaft 104.

FIG. 10 shows a state in which heating roller 40 is disposed on the upstream side of the recording medium passage of fixing pad 30. Specifically, straight line L11 passing through shaft center P1 of rotational shaft 114 and the rotational axis center of heating roller 40 is inclined toward the entrance side (upstream side) of fixing nip N in the figure, relative to vertical line L12 passing through shaft center P1 of rotational shaft 114. As a result, angle B (=72°) of the fixing belt relative to the recording medium discharged from fixing nip N is obviously larger than angle A (°) in FIG. 9.

The arrangement angle of side chassis 111 in the present embodiment can be changed manually, or a driving unit may be separately provided to control the arrangement with a signal. As a specific configuration, a cam for changing the position of side chassis 111, a gear box for driving the cam, and a stepping motor may be mounted to control the arrangement angle of side chassis 111. Alternatively, a linear motor may be used to directly apply displacement force to side chassis 111. By doing this, it is possible to easily change the state (heating roller 40 arrangement) depending on the kind of recording medium.

In the state in FIG. 9, since the fixing belt angle (A (°)) relative to the discharged recording medium is small as previously mentioned, the separability of the recording medium from fixing belt 20 tends to be low. However, even when heating roller 40 is driven in this state, the belt curvature in the vicinity of the exit of fixing pad 30 is small and the load on the belt is small.

Conversely, in the state in FIG. 10, the fixing belt angle (B (°), B>A) relative to the recording medium is large, and the separation performance of the recording medium from fixing belt 20 is generally high. When heating roller 40 is driven, the belt curvature in the vicinity of the exit of fixing pad 30 is large and exerts load.

Since the direction of force of belt tension applied on fixing pad 30 is close to the vertical, the friction force between fixing belt 20 and fixing pad 30 is large. For this reason, the driving torque of heating roller 40 may increase and the belt load may further increase.

As previously mentioned, when pressing roller 10 is the main drive, the recording medium sandwiched between fixing belt 20 and pressing roller 10 undergoes shear force. This is disadvantageous for a recording medium having large projections and depressions on the surface. Therefore, for a recording medium having large projections and depressions on the surface, the drive control may be performed to include the driving of heating roller 40 in the state shown in FIG. 9. In other words, the fixing belt angle relative to the recording medium is reduced, and heating roller 40 mainly performs driving or heating roller 40 assists in driving with a driving force that does not cause the shear force problem as described above.

On the other hand, for a recording media other than the recording medium having large projections and depressions on the surface, control is performed such that pressing roller 10 is the main drive in the state shown in FIG. 10.

In the following, as shown in FIG. 9, the control of torque distribution between pressing roller 10 and heating roller 40 in the case where the fixing belt angle (A (°)) relative to the recording medium is small and heating roller 40 is the main drive or heating roller 40 assists in driving is referred to as "mode I". On the other hand, as shown in FIG. 10, the control of torque distribution between pressing roller 10 and heating roller 40 in the case where the fixing belt angle (B (°)) relative to the recording medium is large and pressing roller 10 is the main drive is referred to as "mode II". In both modes, the torque distribution can be finely adjusted.

Fixing device 100A in the present embodiment employs the method of changing the belt discharge angle as the belt load reducing device as described above in conjunction with the torque distribution.

Second Embodiment: Fixing Device 200 . . . Changing Belt Discharge Angle

Figure 11:
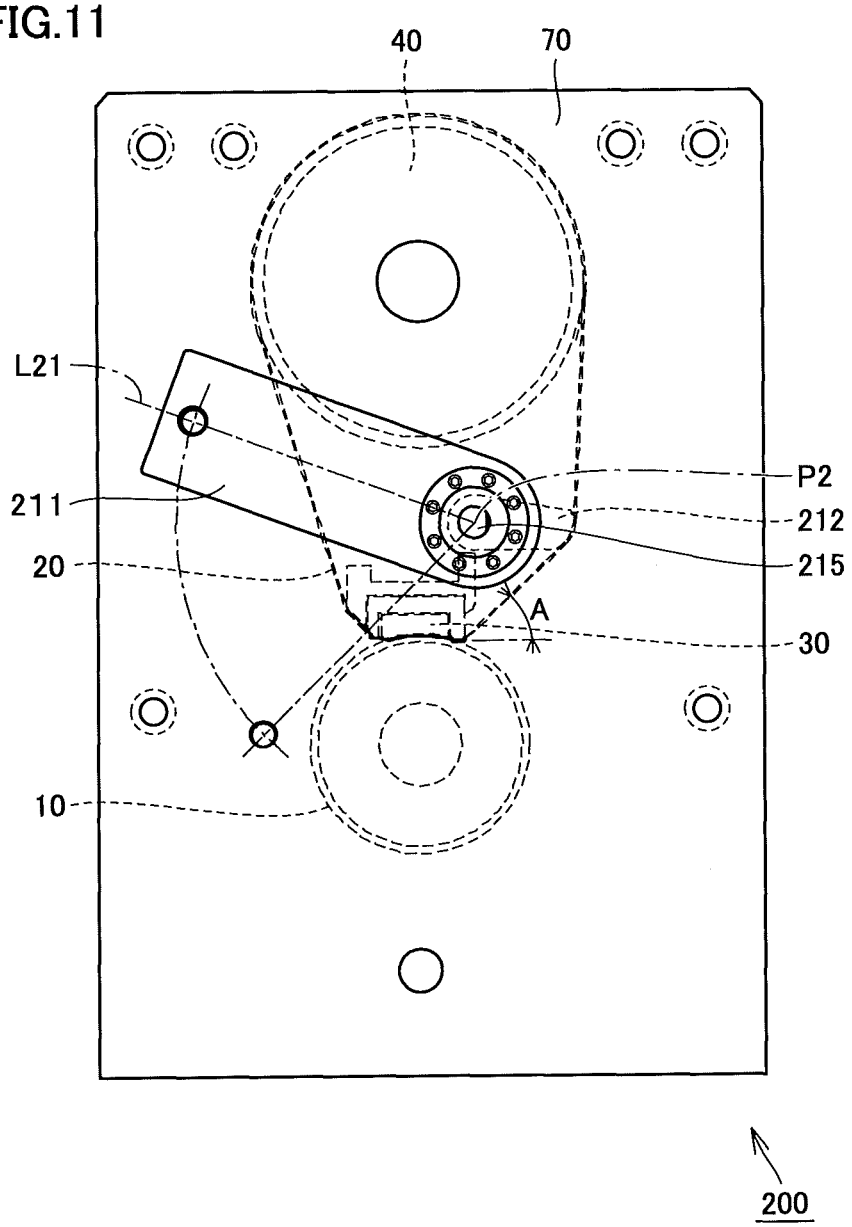
FIG. 11 is a diagram showing a control state in "mode I" in the fixing device in a second embodiment.
Figure 12:
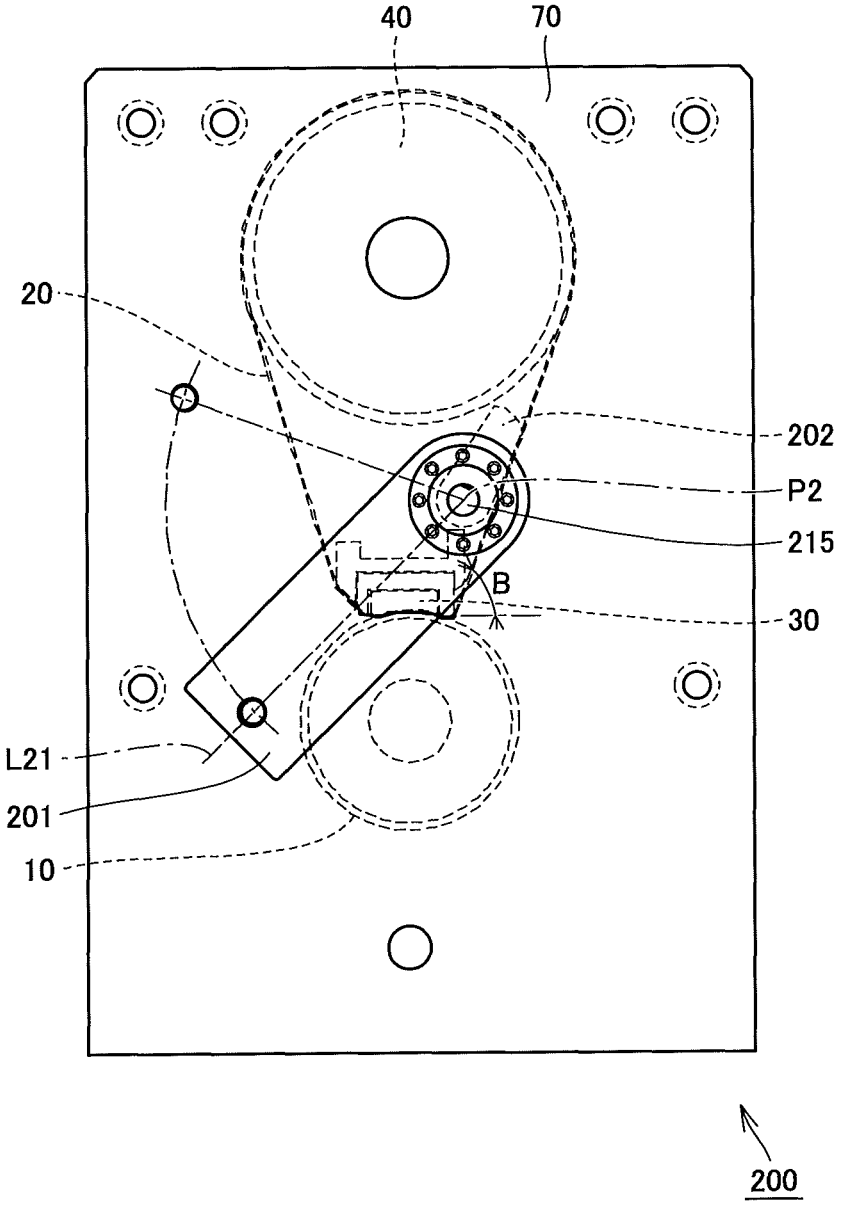
FIG. 12 is a diagram showing a control state in "mode II" in the fixing device in the second embodiment.

Referring to FIG. 11 and FIG. 12, a fixing device 200 in a second embodiment will be described. The principal member configuration and structure is the same as in fixing device 100 and fixing device 100A above, and an overlapping description will not be repeated. FIG. 11 is a diagram showing the control state "in mode I" in fixing device 200, and FIG. 12 is a diagram showing the control state in "mode II" in fixing device 200.

Referring to FIG. 11, this fixing device 200 is configured such that the angle of fixing belt 20 fed from fixing pad 30 is changed by a belt pushing member 212. Belt pushing member 212 is a cam fixed to a shaft 215, arranged on the inner surface of fixing belt 20, and rotatably fixed to side chassis 70 by shaft 215 in parallel with fixing pad 30.

Shaft 72 has a switch handle 211 fixed thereto. This switch handle 211 is swung upward or downward to turn belt pushing member 212 to push fixing belt 20 form the inner surface whereby the belt discharge angle from fixing pad 30 can be changed freely. Switch handle 211 may be manually controlled, or a drive unit may be separately provided to control the arrangement with a signal.

In the state shown in FIG. 11, handle axis L21 passing through center P2 of shaft 215 of switch handle 211 is located above the horizontal line. This is a state in which the fixing belt angle (A (42°)) relative to the recording medium is small and the control in "mode I" is enabled with heating roller 40 as the main drive.

In the state shown in FIG. 12, handle axis L21 passing through center P2 of shaft 215 of switch handle 211 is located below the horizontal line. This is a state in which the fixing belt angle (B (72°)) relative to the recording medium is large and the control in "mode II" is enabled with pressing roller 10 as the main drive.

Fixing device 200 in the present embodiment employs the method of changing the belt discharge angle as the belt load reducing device as described above in conjunction with the torque distribution.

Third Embodiment: Fixing Device 300 . . . Changing Belt Discharge Angle

Figure 13:
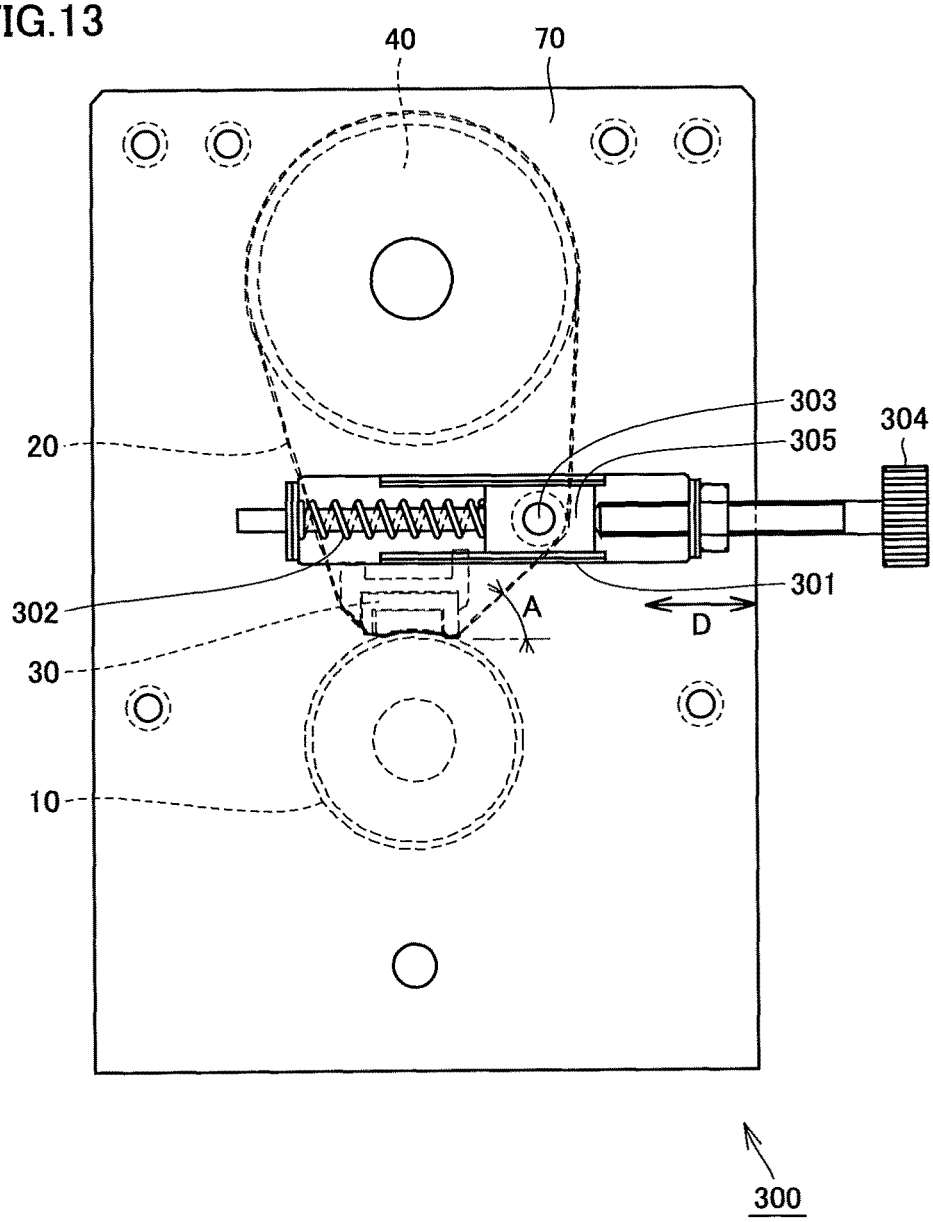
FIG. 13 is a diagram showing a control state in "mode I" in the fixing device in a third embodiment.

Referring to FIG. 13, a fixing device 300 in a third embodiment will be described. The principal member configuration and structure is the same as in the above-noted fixing device 100, 100A, 200, and an overlapping description will not be repeated. FIG. 13 is a diagram showing the control state in "mode I" in fixing device 300.

Referring to FIG. 13, this fixing device 300 is configured such that the angle of fixing belt 20 fed from fixing pad 30 is changed by an idle roller 304. Idle roller 304 is supported by a bearing 301 on side chassis 70 so as to be movable horizontally. In the inside of bearing 301, a sliding member 305 with a guide roller 303 is disposed.

Sliding member 305 is biased toward idle roller 304 by a spring member 302. Idle roller 304 is turned about its axis to move in the right-left direction in the figure, and sliding member 305 also moves in the right-left direction along with this movement. As a result, guide roller 303 in abutment with fixing belt 20 from the inside moves in the right-left direction whereby the angle of fixing belt 20 can be changed freely.

The state shown in FIG. 13 is a state in which guide roller 303 is located on the right side in the figure to reduce the fixing belt angle (A (42°)) relative to the recording medium and the control in "mode I" is enabled with heating roller 40 as the main drive. Though not shown, idle roller 304 can be screwed to locate guide roller 303 on the left side in the figure whereby the fixing belt angle ((72°)) relative to the recording medium is increased to enable the control in "mode II" with pressing roller 10 as the main drive.

Fixing device 300 in the present embodiment employs the method of changing the belt discharge angle as the belt load reducing device as described above in conjunction with the torque distribution.

Fourth Embodiment: Fixing Device 400 . . . Pushing Force Adjustment

Figure 14:
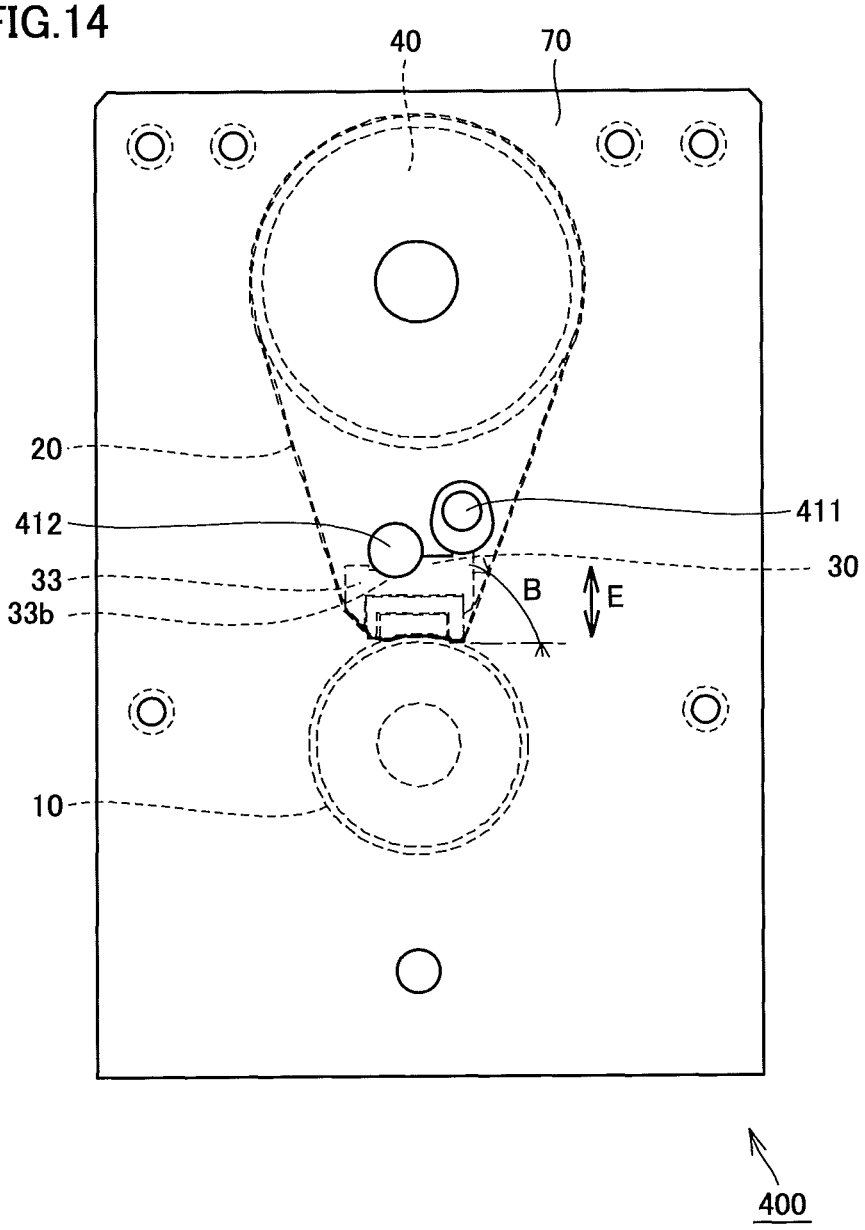
FIG. 14 is a diagram showing a control state in "mode II" in the fixing device in a fourth embodiment.

Referring to FIG. 14, a fixing device 400 in a fourth embodiment will be described. The principal member configuration and structure is the same as in the above-noted fixing device 100, 100A, 200, 300, and an overlapping description will not be repeated. FIG. 14 is a diagram showing the control state in "mode II" in fixing device 400.

In fixing device 400 in the fourth embodiment, a circular groove 33*b* in which the surface of a fixed shaft 412 is fitted is provided on the upper surface of pad holder 33 that is the base material of fixing pad 30. Pad holder 33 is swingable about the shaft center of fixed shaft 412. Fixed shaft 412 is fixed to side chassis 70 and positioned.

Circular groove 33*b* is located upstream from the center of pad holder 33. Thus, when pressure is applied to pressing roller 10 for rotation about fixed shaft 412, the downstream side of fixing pad 30 moves in the up-down direction (the arrow E direction in the figure). In order to suppress the amount of this movement, a cam 411 pushes the downstream portion of pad holder 33 to control the positioning of fixing pad 30.

That is, the pressure on the downstream side of fixing pad 30 can be controlled freely through the rotation of cam 411. Cam 411 may be rotated manually, or a driving unit may be separately provided to control the rotation angle position with a control signal.

In the state shown in FIG. 14, the pressure distribution on the downstream side of fixing pad 30 is high, and "mode II" is selected. As a result, when heating roller 40 is driven, the fixing belt angle of fixing belt 20 relative to the recording medium in the vicinity of the fixing nip exit is large. As previously mentioned, since the friction force between the back surface of fixing belt 20 and fixing pad 30 is high, load is exerted on fixing belt 20.

On the other hand, when cam 411 is rotated, for example, by 180 degrees from the shown state, the downstream side of fixing pad 30 is pushed by pressing roller 10 and lifted upward. As a result, the downstream-side pressure is alleviated to bring about a state in which "mode I" is selected.

Fixing device 400 in the present embodiment employs the method of changing the pressing force on the belt as belt load reducing device as described above in conjunction with the torque distribution.

Figure 15:
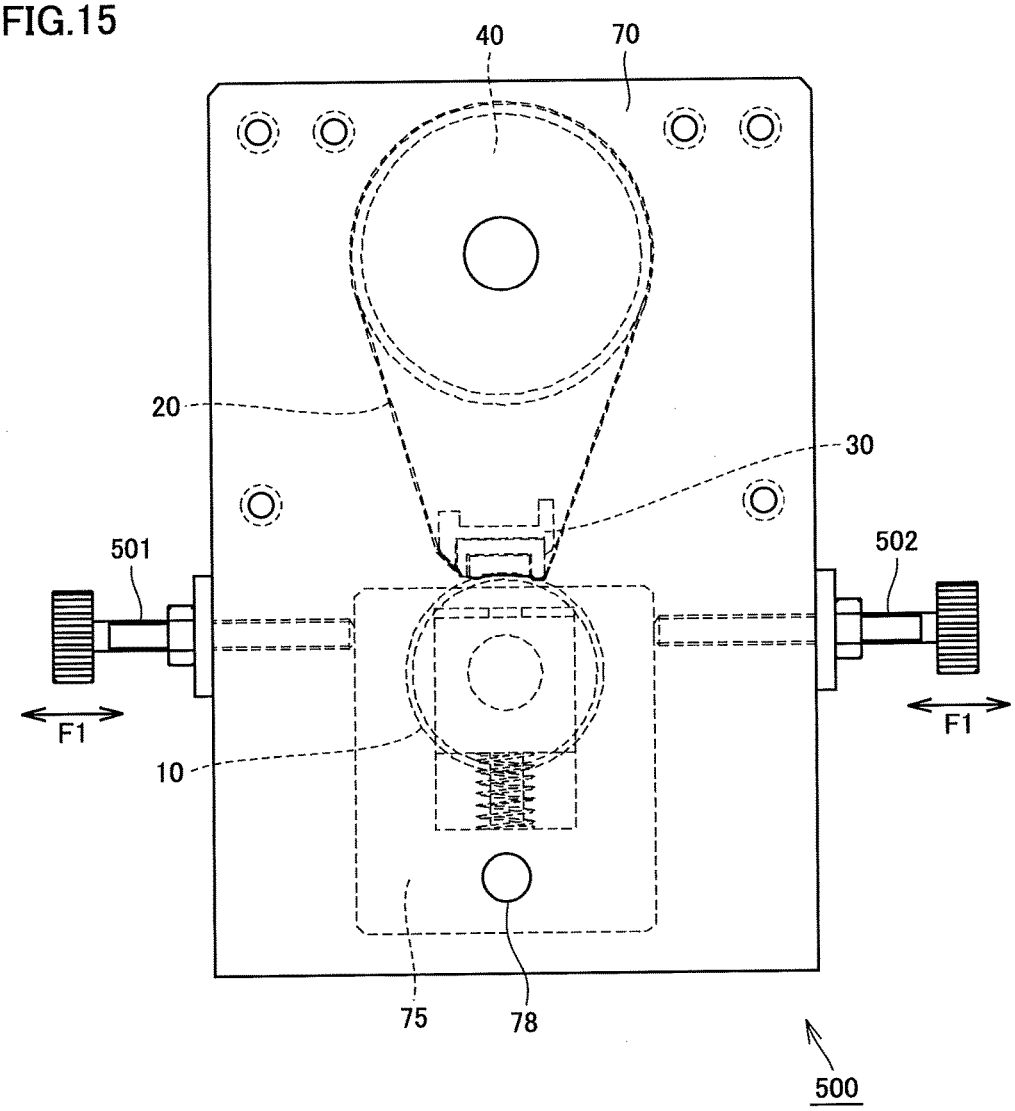
FIG. 15 is a diagram showing a control state in "mode I" in the fixing device in a fifth embodiment.

Fifth Embodiment: Fixing Device 500 . . . Pressing Roller Horizontal Move Referring to FIG. 15, a fixing device 500 in a fifth embodiment will be described. The principal member configuration and structure is the same as in the above-noted fixing device 100, 100A, 200, 300, 400, and an overlapping description will not be repeated. FIG. 15 is a diagram showing the control state in "mode I" in fixing device 500.

Pressing roller 10 is supported by a pressing and retracting mechanism 75 for pressing fixing pad 30 or retracting it from the position opposed to fixing pad 30. Pressing and retracting mechanism 75 is rotatable about a rotational shaft 78, and the arrangement of pressing and retracting mechanism 75 can be adjusted to change the position of pressing roller 10 relative to fixing pad 30.

The position adjustment of pressing roller 10 is performed using pressing roller position adjusting screws 501, 502. When the positions of pressing roller position adjusting screws 501, 502 are adjusted in the F1 direction as appropriate to move pressing roller 10 toward the upstream side of fixing pad 30, the pressure distribution on the downstream side of fixing pad 30 is reduced. That is, even when the heating roller 40 driving is performed in this state, the load on fixing belt 20 is reduced. FIG. 15 is a state in which "mode I" can be selected.

On the other hand, when the positions of pressing roller position adjusting screws 501, 502 are adjusted as appropriate in the F1 direction to move pressing roller 10 toward the downstream side of fixing pad 30, the pressure distribution on the downstream side of fixing pad 30 increases. That is, when the heating roller 40 driving is performed in this state, the load on fixing belt 20 increases. Given this, it is preferable to use pressing roller 10 as the main drive. This is a state in which "mode II" is selected.

Fixing device 400 in the present embodiment employs the method of changing the pressure force on the belt as belt load reducing device as described above in conjunction with the torque distribution.

In the foregoing embodiments, driving units are provided for pressing roller 10 and heating roller 40 to control the torque distribution, whereby shear force occurring on the recording medium can be controlled.

In addition, the device for reducing the belt load at the exit of the fixing nip N is actuated in conjunction with the torque distribution of heating roller 40 to reduce the belt load.

Three methods are employed as the approach for reducing the belt load. The first method of changing the conveyance angle of fixing belt 20 includes a method of changing the relative position between fixing pad 30 and heating roller 40 (the first embodiment) and a method of providing belt pushing member 213 in the vicinity of the exit of fixing nip N to change the conveyance angle of fixing belt 20 (the second and third embodiments).

The second method includes a method of changing the angle of fixing pad 30 to reduce the pressure on the exit side thereby alleviating belt wear (against the pad) and reducing the belt driving force (the fourth embodiment).

The third method is a method of changing the relative position between fixing pad 30 and pressing roller 10 without using the exit of fixing pad 30, thereby alleviating belt wear (against the pad) and reducing the belt driving force (the fifth embodiment).

EXAMPLES

The evaluation results in terms of fixability, belt durability, and separability for the fixing device based on the present embodiments will be described below based on Example 1 to Example 50 and Comparative Example 1 to Comparative Example 5 shown in FIG. 16 to FIG. 22. FIG. 16 to FIG. 22 show the evaluation results in Example 1 to Example 50 and Comparative Example 1 to Comparative Example 5.

(Evaluation Method for Fixability)

For an image obtained based on the conditions shown in FIG. 16 to FIG. 22 (the kind of recording medium, the configuration and the mode of the fixing device, the torque distribution (Th is the torque distribution of heating roller 40, and Tp is the torque distribution of pressing roller 10), shear force, radius of curvature, the pressure at the nip exit), the image section was rubbed with an eraser (sand rubber "LION 26111" manufactured by LION OFFICE PRODUCTS CORP.) twice with a push load of 1 kgf, and the retention ratio of image density was measured by "X-Rite model 404" manufactured by X-Rite Inc. to evaluate the fixability. The fixability was evaluated and ranked into the following three grades.

The grade "A" is given when the image density retention ratio is 90% or higher, the grade "B" is given when the image density retention ratio is 80% or higher and lower than 90%, and the grade "C" is given when the image density retention ratio is less than 80% (see FIG. 22).

(Evaluation Method for Belt Durability)

Similarly, for an image obtained based on the conditions shown in FIG. 16 to FIG. 22, the belt durability was evaluated by idling fixing belt 20 heated to a setting temperature of 180° C. for consecutive 100 hours. The state of the fixing belt after consecutive 100 hours was examined to evaluate the belt durability. The durability was evaluated and ranked into the following three grades (see FIG. 22).

The grade "A" is given when the fixing belt has no damage on the base material and is satisfactory. The grade "B" is given when the fixing belt has slight cracks on the base material. The grade "C" is given when the fixing belt has crack damage on the base material.

(Evaluation Method for Separability)

Similarly, for an image obtained based on the conditions shown in FIG. 16 to FIG. 22, the state of the recording medium output from the fixing unit was examined and evaluated into the following three grades (see FIG. 21).

The grade "A" is given when the image surface is not wound around the fixing belt and no jam occurs during separation. The grade "B" is given when the image surface is momentarily wound around the fixing belt, which, however, does not lead to a jam during separation. The grade "C" is given when the image surface is wound around the fixing belt and a jam occurs during separation.

(Method of Confirming Effects)

The fixing devices shown in the first to fifth embodiments were used to form a fixing image on rough paper and thin coat paper as a recording medium, and the fixability evaluation, the belt durability evaluation, and the separability evaluation were conducted.

The experiment conditions including the recording medium kind, the fixing device, the device configuration (mode), and the torque distribution used in Examples and Comparative Examples are shown in FIG. 16 to FIG. 22. The evaluation results (fixability, separability, belt durability) in Examples and Comparative Examples are also shown in FIG. 16 to FIG. 22.

The recording medium kinds illustrated in FIG. 16 to FIG. 22 will now be described. LEATHAC (registered trademark) 66 is rough paper (manufactured by Tokushu Tokai Paper Co., Ltd.). LEATHAC (registered trademark) 75 is rough paper (manufactured by Tokushu Tokai Paper Co., Ltd.). POD is POD gloss coat paper (manufactured by Oji Paper Co., Ltd., 100 g/m$^2$).

Here, the rough paper (embossed paper) means paper subjected to embossing, where "embossing" refers to the process of pressing a patterned metal roll against to form a pattern during the paper-making stage or after paper making.

Figure 23:
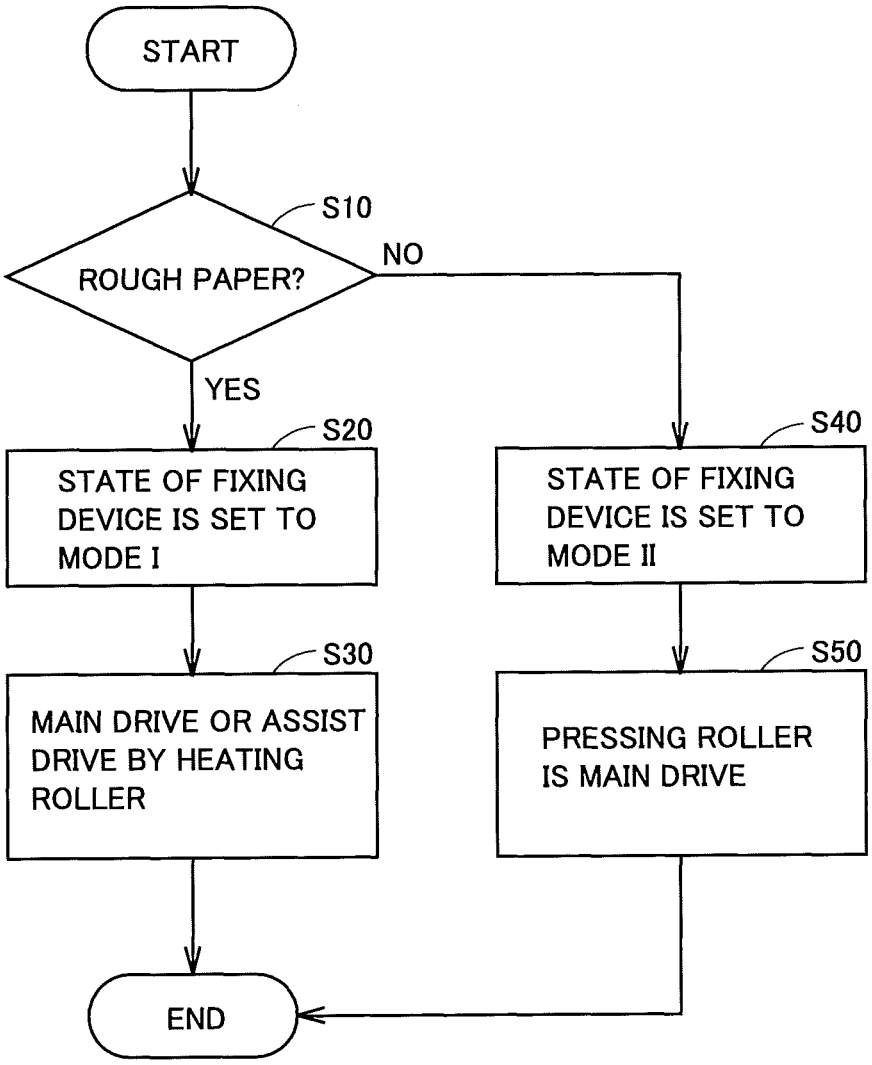
FIG. 23 is a flowchart of mode determination in the case of rough paper.

The flowchart for selecting modes I, II based on whether paper is rough paper in FIG. 23 will be described. In the case of rough paper that requires a predetermined driving force to be applied to heating roller 40 (S10), first, the state of the fixing device is set to "mode I" (S20). Subsequently, control is performed such that the driving torque is applied to heating roller 40 for main driving or assist driving (S30).

On the other hand, in the case of standard paper including thin paper that is not rough paper (S10), the state of fixing device is set to "mode II" (S40). Subsequently, the torque of heating roller 40 is set smaller than in the case of rough paper, and pressing roller 10 is set as the main drive (S50).

Example 1

In Example 1, rough paper (LEATHAC (registered trademark) 66) was used as a recording medium, and an unfixed image was created in the image forming apparatus and then fixed using mode I in the first embodiment as a fixing device, with the torque distribution Th:Tp=20:80, with a heating belt temperature of 180° C., and with the temperature of pressing roller 10 of 100° C.

Employing the heating roller 40 driving for fixing belt 20 reduces the shear force and thus improves the fixability on rough paper. As in mode I, changing the position of heating roller 40 increases the radius of curvature at the fixing nip exit to reduce the belt load, and therefore the durability of fixing belt 20 is improved. Here, although the increased radius of curvature at the fixing nip exit tends to be disadvantageous in terms of the separability, the separability is satisfactory because the rough paper has a large thickness and a large restoring force acts at the fixing nip exit. The results of evaluation are all "A".

Example 2

Example 2 is the same as Example 1 except that the torque distribution is Th:Tp=50:50. The results of evaluation are the same as in Example 1.

Example 3

Example 3 is the same as Example 1 except that the torque distribution is Th:Tp=100:0. The results of evaluation are the same as in Example 1.

Example 4

Example 4 is the same as Example 1 except that the torque distribution is Th:Tp=15:85. The fixability is evaluated as "B", and the result of total evaluation is also "B".

Example 5

Example 5 is the same as Example 1 except that the mode of the fixing device is mode II. The belt durability is evaluated as "B", and the result of total evaluation is also "B".

Example 6

In Example 6, POD was used as a recording medium, and an unfixed image was created in the image forming apparatus and then fixed using mode II in the first embodiment as a fixing device, with the torque distribution Th:Tp=0:100, with a heating belt temperature of 180° C., and with the temperature of pressing roller 10 of 100° C. The results of evaluation are all "A".

Example 7

Example 7 is the same as Example 6 except that the torque distribution is Th:Tp=15:85. The belt durability is evaluated as "B", and the result of total evaluation is also "B".

Example 8

Example 8 is the same as Example 6 except that the torque distribution is Th:Tp=20:80. The belt durability is evaluated as "B", and the result of total evaluation is also "B".

Example 9

Example 9 is the same as Example 6 except that the mode I in the first embodiment is used as the fixing device. The separability is evaluated as "B", and the result of total evaluation is also "B".

Example 10

Example 10 is the same as Example 8 except that the mode I in the first embodiment is used as the fixing device. The separability is evaluated as "B", and the result of total evaluation is also "B".

Example 11

In Example 11, rough paper (LEATHAC (registered trademark) 76) was used as a recording medium, and an unfixed image was created in the image forming apparatus and then fixed using mode I in the second embodiment as a fixing device, with the torque distribution Th:Tp=20:80, with a heating belt temperature of 180° C., and with the temperature of pressing roller 10 of 100° C. The results of evaluation are all "A".

Example 12

Example 12 is the same as Example 11 except that the torque distribution is Th:Tp=50:50. The results of evaluation are the same as in Example 11.

Example 13

Example 13 is the same as Example 11 except that the torque distribution is Th:Tp=100:0. The results of evaluation are the same as in Example 11.

Example 14

Example 14 is the same as Example 11 except that the torque distribution is Th:Tp=15:85. The fixability is evaluated as "B", and the result of total evaluation is also "B".

Example 15

Example 15 is the same as Example 11 except that the mode of the fixing device is mode II. The belt durability is evaluated as "B", and the result of total evaluation is also "B".

Example 16

In Example 16, POD was used as a recording medium, and an unfixed image was created in the image forming apparatus and then fixed using mode II in the second embodiment as a fixing device, with the torque distribution Th:Tp=0:100, with a heating belt temperature of 180° C., and with the temperature of pressing roller 10 of 100° C. The results of evaluation are all "A".

Example 17

Example 17 is the same as Example 16 except that the torque distribution is Th:Tp=15:85. The belt durability is evaluated as "B", and the result of total evaluation is also "B".

Example 18

Example 18 is the same as Example 16 except that the torque distribution is Th:Tp=20:80. The belt durability is evaluated as "B", and the result of total evaluation is also "B".

Example 19

Example 19 is the same as Example 16 except that mode I in the second embodiment is used as a fixing device. The separability is evaluated as "B", and the result of total evaluation is also "B".

Example 20

Example 20 is the same as Example 18 except that mode I in the second embodiment is used as a fixing device. The belt durability is evaluated as "B", and the result of total evaluation is also "B".

Example 21

In Example 21, rough paper (LEATHAC (registered trademark) 66) was used as a recording medium, and an unfixed image was created in the image forming apparatus and then fixed using mode I in the third embodiment as a fixing device, with the torque distribution Th:Tp=20:80, with a heating belt temperature of 180° C., and with the temperature of pressing roller 10 of 100° C. The results of evaluation are all "A".

Example 22

Example 22 is the same as Example 21 except that the torque distribution is Th:Tp=55:45. The results of evaluation are the same as in Example 21.

Example 23

Example 23 is the same as Example 21 except that the torque distribution is Th:Tp=100:0. The results of evaluation are the same as in Example 21.

Example 24

Example 24 is the same as Example 21 except that the torque distribution is Th:Tp=15:85. The fixability is evaluated as "B", and the result of total evaluation is also "B".

Example 25

Example 25 is the same as Example 1 except that the mode of the fixing device is mode II. The belt durability is evaluated as "B", and the result of total evaluation is also "B".

Example 26

In Example 26, POD was used as a recording medium, and an unfixed image was created in the image forming apparatus and then fixed using mode II in the third embodiment as a fixing device, with the torque distribution Th:Tp=0:100, with a heating belt temperature of 180° C., and with the temperature of pressing roller 10 of 100° C. The results of evaluation are all "A".

Example 27

Example 27 is the same as Example 26 except that the torque distribution is Th:Tp=15:85. The belt durability is evaluated as "B", and the result of total evaluation is also "B".

Example 28

Example 28 is the same as Example 26 except that the torque distribution is Th:Tp=20:80. The belt durability is evaluated as "B", and the result of total evaluation is also "B".

Example 29

Example 29 is the same as Example 26 except that mode I in the third embodiment is used as a fixing device. The separability is evaluated as "B", and the result of total evaluation is also "B".

Example 30

Example 30 is the same as Example 28 except that mode I in the third embodiment is used as a fixing device. The separability is evaluated as "B", and the result of total evaluation is also "B".

Example 31

In Example 31, rough paper (LEATHAC (registered trademark) 66) was used as a recording medium, and an unfixed image was created in the image forming apparatus and then fixed using mode I in the fourth embodiment as a fixing device, with the torque distribution Th:Tp=20:80, with a heating belt temperature of 180° C., and with the temperature of pressing roller 10 of 100° C. The results of evaluation are all "A".

Example 32

Example 32 is the same as Example 31 except that the torque distribution is Th:Tp=55:45. The results of evaluation are the same as in Example 31.

Example 33

Example 33 is the same as Example 31 except that the torque distribution is Th:Tp=100:0. The results of evaluation are the same as in Example 31.

Example 34

Example 34 is the same as Example 31 except that the torque distribution is Th:Tp=15:85. The fixability is evaluated as "B", and the result of total evaluation is also "B".

Example 35

Example 35 is the same as Example 31 except that the mode of the fixing device is mode II. The belt durability is evaluated as "B", and the result of total evaluation is also "B".

Example 36

In Example 36, POD was used as a recording medium, and an unfixed image was created in the image forming apparatus and then fixed using mode II in the fourth embodiment as a fixing device, with the torque distribution Th:Tp=0:100, with a heating belt temperature of 180° C., and with the temperature of pressing roller 10 of 100° C. The results of evaluation are all "A".

Example 37

Example 37 is the same as Example 36 except that the torque distribution is Th:Tp=15:85. The belt durability is evaluated as "B", and the result of total evaluation is also "B".

Example 38

Example 38 is the same as Example 36 except that the torque distribution is Th:Tp=20:80. The belt durability is evaluated as "B", and the result of total evaluation is also "B".

Example 39

Example 39 is the same as Example 36 except that mode I in the fourth embodiment was used as a fixing device. The separability is evaluated as "B", and the result of total evaluation is also "B".

Example 40

Example 40 is the same as Example 38 except that mode I in the fourth embodiment is used as a fixing device. The separability is evaluated as "B", and the result of total evaluation is also "B".

Example 41

In Example 41, rough paper (LEATHAC (registered trademark) 75) was used as a recording medium, and an unfixed image was created in the image forming apparatus and then fixed using mode I in the fifth embodiment as a fixing device, with the torque distribution Th:Tp=20:80, with a heating belt temperature of 180° C., and with the temperature of pressing roller 10 of 100° C. The results of evaluation are all "A".

Example 42

Example 42 is the same as Example 41 except that the torque distribution is Th:Tp=55:45. The results of evaluation are the same as in Example 41.

Example 43

Example 43 is the same as Example 41 except that the torque distribution is Th:Tp=100:0. The results of evaluation are the same as in Example 41.

Example 44

Example 44 is the same as Example 41 except that the torque distribution is Th:Tp=15:85. The fixability is evaluated as "B", and the result of total evaluation is also "B".

Example 45

Example 45 is the same as Example 41 except that the mode of the fixing device is mode II. The belt durability is evaluated as "B", and the result of total evaluation is also "B".

Example 46

In Example 46, POD was used as a recording medium, and an unfixed image was created in the image forming apparatus and then fixed using mode II in the fifth embodiment as a fixing device, with the torque distribution Th:Tp=0:100, with a heating belt temperature of 180° C., and with the temperature of pressing roller 10 of 100° C. The results of evaluation are all "A".

Example 47

Example 47 is the same as Example 46 except that the torque distribution is Th:Tp=15:85. The belt durability is evaluated as "B", and the result of total evaluation is also "B".

Example 48

Example 48 is the same as Example 46 except that the torque distribution is Th:Tp=20:80. The belt durability is evaluated as "B", and the result of total evaluation is also "B".

Example 49

Example 49 is the same as Example 46 except that mode I in the fourth embodiment is used as a fixing device. The separability is evaluated as "B", and the result of total evaluation is also "B".

Example 50

Example 50 is the same as Example 38 except that mode I in the fourth embodiment is used as a fixing device. The separability is evaluated as "B", and the result of total evaluation is also "B".

Comparative Example 1

In Comparative Example 1, rough paper (LEATHAC (registered trademark) 66) was used as a recording medium, and an unfixed image was created in the image forming apparatus and then fixed using mode I in the first embodiment as a fixing device, with the torque distribution Th:Tp=0:100, with a heating belt temperature of 180° C., and with the temperature of pressing roller 10 of 100° C. The fixability is evaluated as "C", and the result of total evaluation is also "C".

Comparative Example 2

In Comparative Example 2, rough paper (LEATHAC (registered trademark) 75) was used as a recording medium, and an unfixed image was created in the image forming apparatus and then fixed using mode I in the second embodiment as a fixing device, with the torque distribution Th:Tp=0:100, with a heating belt temperature of 180° C., and with the temperature of pressing roller 10 of 100° C. The fixability is evaluated as "C", and the result of total evaluation is also "C".

Comparative Example 3

In Comparative Example 3, rough paper (LEATHAC (registered trademark) 66) was used as a recording medium, and an unfixed image was created in the image forming apparatus and then fixed using mode I in the third embodiment as a fixing device, with the torque distribution Th:Tp=0:100, with a heating belt temperature of 180° C., and with the temperature of pressing roller 10 of 100° C. The fixability is evaluated as "C", and the result of total evaluation is also "C".

Comparative Example 4

In Comparative Example 4, rough paper (LEATHAC (registered trademark) 66) was used as a recording medium, and an unfixed image was created in the image fonning apparatus and then fixed using mode I in the fourth embodiment as a fixing device, with the torque distribution Th:Tp=0:100, with a heating belt temperature of 180° C., and with the temperature of pressing roller 10 of 100° C. The fixability is evaluated as "C", and the result of total evaluation is also "C".

Comparative Example 5

In Comparative Example 5, rough paper (LEATHAC (registered trademark) 75) was used as a recording medium, and an unfixed image was created in the image forming apparatus and then fixed using mode I in the fifth embodiment as a fixing device, with the torque distribution Th:Tp=0:100, with a heating belt temperature of 180° C., and with the temperature of pressing roller 10 of 100° C. The fixability is evaluated as "C", and the result of total evaluation is also "C".

Based on the evaluation results of Example 1 to Example 50 and Comparative Example 1 to Comparative Example 5, when the recording medium is rough paper, it is preferable that the torque distribution (Th:Tp) between the driving torque Th of heating roller 40 and the driving torque Tp of pressing roller 10 is 20:80 to 100:0.

This fixing device fixes a toner image on a recording medium. The fixing device includes an endless fixing belt, a heating roller disposed in a loop of the fixing belt to drive the belt, a pressing roller disposed to be opposed to the fixing belt to form a fixing nip through which the recording medium passes, a pressing roller driving unit configured to drive the pressing roller, a heating roller driving unit configured to drive the heating roller, a fixing pad disposed in the loop of the fixing belt so as to be opposed to the pressing roller, a belt load reducing device configured to reduce load on the fixing belt on the exit side of the fixing nip, and a control unit configured to control the pressing roller driving unit, the heating roller driving unit, and the belt load reducing device.

The control unit performs control such that torque of the heating roller in torque distribution between the pressing roller and the heating roller is greater when the belt load reducing device is activated than when the belt load reducing device is not activated.

In another mode, the belt load reducing device changes a discharge angle of the fixing belt from the fixing nip.

In another mode, the belt load reducing device changes the discharge angle of the fixing belt by changing a position of the heating roller.

In another mode, the belt load reducing device changes the discharge angle of the fixing belt by using a belt pushing member in abutment with the fixing belt from the inside in a downstream direction of the fixing nip.

In another mode, the belt load reducing device changes the discharge angle of the fixing belt by using an idle roller in abutment with the fixing belt from the inside in a downstream direction of the fixing nip.

In another mode, the belt load reducing device changes a pressing force of the pressing roller on the fixing pad.

In another mode, the belt load reducing device changes the pressing force on the fixing pad by changing an installation angle of the fixing pad.

In another mode, the belt load reducing device changes the pressing force on the fixing pad by changing a relative position between the fixing pad and the pressing roller.

In another mode, when the recording medium is rough paper, control is performed to apply torque at least to the heating roller for assist operation.

In another mode, when the recording medium is rough paper, torque distribution between driving torque of the heating roller and driving torque of the pressing roller is 20:80 to 100:0.

In another mode, when the recording medium is standard paper including thin paper, control is performed such that driving of the pressing roller is main drive.

This image forming apparatus includes the fixing device according to any of the above.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing device configured to fix a toner image on a recording medium, comprising:

an endless fixing belt;

a heating roller disposed in a loop of the fixing belt to drive the belt;

a pressing roller disposed to be opposed to the fixing belt to form a fixing nip through which the recording medium passes;

a pressing roller driving unit configured to drive the pressing roller;

a heating roller driving unit configured to drive the heating roller;

a fixing pad disposed in the loop of the fixing belt so as to be opposed to the pressing roller;

a belt load reducing device configured to reduce load on the fixing belt on an exit side of the fixing nip; and a control unit configured to control the pressing roller driving unit, the heating roller driving unit, and the belt load reducing device, wherein, when the fixing nip is under pressure and the heating roller and the pressing roller both rotate, the control unit performs control such that torque of the heating roller in torque distribution between the pressing roller and the heating roller is greater when the belt load reducing device is activated than when the belt load reducing device is not activated.

2. The fixing device according to claim 1, wherein the belt load reducing device changes a discharge angle of the fixing belt from the fixing nip.

3. The fixing device according to claim 2, wherein the belt load reducing device changes the discharge angle of the fixing belt by changing a position of the heating roller.

4. The fixing device according to claim 2, wherein the belt load reducing device changes the discharge angle of the fixing belt by using a belt pushing member in abutment with the fixing belt from inside in a downstream direction of the fixing nip.

5. The fixing device according to claim 2, wherein the belt load reducing device changes the discharge angle of the fixing belt by using an idle roller in abutment with the fixing belt from inside in a downstream direction of the fixing nip.

6. The fixing device according to claim 1, wherein the belt load reducing device changes a pressing force of the pressing roller on the fixing pad.

7. The fixing device according to claim 6, wherein the belt load reducing device changes the pressing force on the fixing pad by changing an installation angle of the fixing pad.

8. The fixing device according to claim 6, wherein the belt load reducing device changes the pressing force on the fixing pad by changing a relative position between the fixing pad and the pressing roller.

9. The fixing device according to claim 1, wherein when the recording medium is rough paper, control is performed to apply torque at least to the heating roller for assist operation.

10. The fixing device according to claim 1, wherein when the recording medium is rough paper, a ratio of torque distribution between driving torque of the heating roller and driving torque of the pressing roller is from 20%:80% to 100%:0%.

11. The fixing device according to claim 1, wherein when the recording medium is standard paper including thin paper, control is performed such that driving of the pressing roller is main drive.

12. An image forming apparatus comprising a fixing device configured to fix a toner image on a recording medium, the fixing device including:

an endless fixing belt;

a heating roller disposed in a loop of the fixing belt to drive the belt;

a pressing roller disposed to be opposed to the fixing belt to form a fixing nip through which the recording medium passes;

a pressing roller driving unit configured to drive the pressing roller;

a heating roller driving unit configured to drive the heating roller;

a fixing pad disposed in the loop of the fixing belt so as to be opposed to the pressing roller;

a belt load reducing device configured to reduce load on the fixing belt on an exit side of the fixing nip; and a control unit configured to control the pressing roller driving unit, the heating roller driving unit, and the belt load reducing device, wherein, when the fixing nip is under pressure and the heating roller and the pressing roller both rotate, the control unit performs control such that torque of the heating roller in torque distribution between the pressing roller and the heating roller is greater when the belt load reducing device is activated than when the belt load reducing device is not activated.

13. The fixing device according to claim 1, wherein the control performed by the control unit includes torque control, in torque control mode, of at least one of the pressing roller driving unit and the heating roller driving unit.

14. The image forming apparatus according to claim 12, wherein the control performed by the control unit includes torque control, in torque control mode, of at least one of the pressing roller driving unit and the heating roller driving unit.

* * * * *